US010053273B2

(12) United States Patent
Petrucci et al.

(10) Patent No.: US 10,053,273 B2
(45) Date of Patent: Aug. 21, 2018

(54) RECLOSABLE PACKAGE OF CIGARETTES AND RESPECTIVE PACKING METHOD

(71) Applicant: G.D SOCIETA' PER AZIONI, Bologna (IT)

(72) Inventors: Luca Petrucci, Castelfranco Emilia (IT); Roberto Polloni, Modigliana (IT); Fabio Pasquino, Torno (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 0 days.

(21) Appl. No.: 15/507,775

(22) PCT Filed: Sep. 4, 2015

(86) PCT No.: PCT/IB2015/056763
§ 371 (c)(1),
(2) Date: Mar. 1, 2017

(87) PCT Pub. No.: WO2016/035046
PCT Pub. Date: Mar. 10, 2016

(65) Prior Publication Data

US 2017/0283150 A1 Oct. 5, 2017

(30) Foreign Application Priority Data

Sep. 5, 2014 (IT) ..... BO2014A0491

(51) Int. Cl.
*A24F 15/00* (2006.01)
*B65D 77/20* (2006.01)
(Continued)

(52) U.S. Cl.
CPC ..... *B65D 77/2096* (2013.01); *A24F 15/12* (2013.01); *B65B 11/004* (2013.01);
(Continued)

(58) Field of Classification Search
CPC ..... B65D 85/1036; B65D 85/10; A24F 15/00
(Continued)

(56) References Cited

U.S. PATENT DOCUMENTS 7,428,967 B2 * 9/2008 Petrucci ..... B65D 5/4291 206/242
7,604,117 B2 * 10/2009 Bourgoin ..... B65D 85/1054 206/267

FOREIGN PATENT DOCUMENTS

EP 2361839 A1 8/2011
EP 2366637 A1 9/2011
WO WO-02079051 A1 10/2002

OTHER PUBLICATIONS

International Search Report for PCT patent application No. PCT/IB2015/056763, dated Dec. 3, 2015.

* cited by examiner

*Primary Examiner* — King M Chu
(74) *Attorney, Agent, or Firm* — Marshall, Gerstein & Borun LLP

(57) ABSTRACT

Reclosable package of cigarettes, comprising:
- a group of cigarettes;
- a soft envelope having a parallelepiped shape and comprising a front surface, a rear surface, a top surface, a bottom surface and two side surfaces, the envelope encloses the group of cigarettes and is provided with a cigarette extraction opening;
- a stiffening element wrapping the envelope along at least two opposite surfaces of the envelope and at the extraction opening;
- a reclosable opening system consisting in an adhesive closing panel superimposed in a removable manner on an adhesive frame panel, the opening system covers the extraction opening;

(Continued)

wherein the closing panel is movable between an opening position and a closing position of the extraction opening, and wherein the opening system is fastened to the stiffening element by firmly superimposing the frame panel on at least two opposite walls of the stiffening element and at the extraction opening.

23 Claims, 22 Drawing Sheets

(51) Int. Cl.

| | |
|---|---|
| ***B65B 11/00*** | (2006.01) |
| ***B65B 19/04*** | (2006.01) |
| ***B65B 19/22*** | (2006.01) |
| ***B65B 61/18*** | (2006.01) |
| ***B65D 77/02*** | (2006.01) |
| ***B65D 85/10*** | (2006.01) |
| ***A24F 15/12*** | (2006.01) |

(52) U.S. Cl.
CPC ..... *B65B 19/04* (2013.01); *B65B 19/22* (2013.01); *B65B 61/18* (2013.01); *B65D 77/02* (2013.01); *B65D 85/1045* (2013.01)

(58) Field of Classification Search
USPC ..... 206/273
See application file for complete search history.

RECLOSABLE PACKAGE OF CIGARETTES AND RESPECTIVE PACKING METHOD

CROSS-REFERENCE TO RELATED APPLICATIONS

This is the U.S. national phase of International Application No. PCT/IB2015/056763, filed Sept. 4, 2015, which claims the benefit of Italian Patent Application No. BO2014A000491, filed Sept. 5, 2014.

TECHNICAL FIELD

The present invention relates to a reclosable package of cigarettes, wherein the reclosable opening system is constituted by a closing panel removably coupled to a frame panel. In particular, the present invention relates to a reclosable package of cigarettes wherein the opening system is firmly fastened to a stiffening element of the package which at least partially wraps the inner envelope of a group of cigarettes.

In a further aspect, the present invention relates to a packing method of a reclosable package of cigarettes. In particular, the present invention relates to a method for applying a reclosable opening system to a package of cigarettes.

PRIOR ART

Commonly, the packages of cigarettes comprise a group of cigarettes enveloped in a soft inner envelope. Said packages can be divided into rigid type packages, in which the soft inner envelope is enclosed within a rigid outer container, or soft type packages, in which the same envelope is further wrapped with an inner container made of paper or light-weight cardboard. The access to the inner envelope is obtained through an access opening which can be closed, for example by means of a hinged lid in the case of rigid type packages or through a portion of the same outer container in the case of soft type packages.

The soft inner envelope is made by wrapping a group of cigarettes around a suitably shaped wrapping sheet. In this regard, in order to preserve the organoleptic characteristics of the tobacco contained in cigarettes, it is known to produce an inner sealed type envelope, obtained by folding and heat-sealing a wrapping sheet of impermeable material.

To allow the extraction of the cigarettes from the inner envelope, an extraction opening is made on the wrapping sheet, which is covered by a closing element of repositionable type after the first opening thereof. This is normally made by means of a panel provided with non-drying repositionable adhesive on the peripheral portions in contact with the inner container known as of an "open and closeable" type. It is further known to provide said closing element with a gripping tab for the user, which is devoid of adhesive and is adapted to facilitate the handling of the closing element. Therefore, to lift and reposition the panel, a user can easily grasp the gripping tab which is not in any way fixed to the underlying inner envelope but simply superimposed on the same, and kept in position by the integral coupling with the panel.

The production of an at least partially heat-sealed or sealed type inner envelope requires the use of labour-intense and expensive materials. The plastic material used for the production of the inner envelope has, in fact, a high supply cost and the necessity of suitable closing means which allow to hold the closed envelope during advancement along the packing direction of the packing machine. In particular, it is necessary to provide plate welders suited to hold the inner envelope and simultaneously increase the temperature along the superimposed portions to allow the coupling by heat sealing or by induction sealing. To obtain effective closure it is also necessary to provide suitable contrast means cooperating with sealing means to obtain an effective and long lasting coupling.

To obtain a correct sealing and at the same time protect the content, the inner envelope of the abovementioned packages comprises an internal stiffening element, preferably of cardboard, which envelops the group of cigarettes at least on the sides. Said element becomes a contrast means during sealing operations by improving the seal of the package but increasing the unit cost.

The stiffening element also complicates the wrapping operations, delaying production time and worsening the aesthetic qualities of the package. The thickening of the inner envelope due to the stiffening element also makes it difficult to insert an additional outer innerframe which can be helpful for keeping a possible hinged lid closed.

A further type of known sealed packages are the fluid-tight packages. These are produced by using a packing method referred to as "flow-pack", wherein around a succession of groups of cigarettes a tubular wrapping is formed by means of a continuous longitudinal sealing of a tape of wrapping material that is wound into a tube around the group. Subsequently, the tubular wrapping is sealed and cut transversely upstream and downstream from each group of cigarettes to obtain the single sealed inner package. This latter type of sealed package described allows optimal preservation of the organoleptic characteristics of the tobacco of the group of cigarettes. However, the use of expensive thermoplastic material and the implementation of a specialized machine using a "flow-pack" wrapping system is necessary also in said case.

Regardless of the packing method used, it is necessary that the material used to produce the inner envelope is, therefore, of a heat-sealable type. Moreover, having regard to the need to have a repositionable closing element for reclosing the package also after the first use, it is necessary that the material used would not allow absorbing the aqueous component of the non-drying adhesive provided on the closing element. To satisfy said conditions is, therefore, necessary that the material forming the inner envelope is of a thermoplastic type, suitable for the above uses, but particularly expensive and difficult to manipulate during the packing operations.

It would therefore be desirable to have a package of cigarettes suited to minimize the above drawbacks. In particular, it would be desirable to have a package of cigarettes reclosable and inexpensive to produce.

It would therefore be desirable to have a package of cigarettes of simple production with common packing machines or with minor modifications to the same.

Finally, it would be desirable to have a reclosable type package of cigarettes having a pleasant aesthetic appearance.

DESCRIPTION OF THE INVENTION

The object of the present invention is to provide a package of cigarettes having the extraction opening of the group of cigarettes reclosable and, at the same time, being inexpensive to produce.

In particular, object of the present invention is to provide a reclosable package of cigarettes and that can be produced with inexpensive wrapping materials and with less complex wrapping processes.

A further object of the present invention is to provide a packing method for producing a reclosable package of cigarettes.

The purposes mentioned above are obtained by a reclosable package of cigarettes, according to the accompanying claims.

The package comprises:

a group of cigarettes;

a soft envelope having a parallelepiped shape and comprising a front surface, a rear surface, a top surface, a bottom surface and two side surfaces, the envelope encloses the group of cigarettes and is provided with an extraction opening for the cigarettes;

a stiffening element wrapping the envelope along at least two opposite surfaces of said envelope and at the cigarette extraction opening;

a reclosable opening system consisting in an adhesive closing panel superimposed in a removable manner on an adhesive frame panel, the opening system covers said extraction opening;

wherein the closing panel is movable between an opening position, in which the closing panel is at least partially detached from the frame panel for accessing the extraction opening, and a closing position, in which the closing panel is superimposed on the frame panel closing the extraction opening;

the package is characterized in that the opening system is fastened to the stiffening element by firmly superimposing the frame panel on at least two opposite walls of the stiffening element and at said extraction opening.

In this way, the opening and reclosing of the inner envelope are obtained with an opening system reclosable and separated with respect to the inner envelope and coupled to a stiffening element arranged outside the same envelope.

Preferably, the frame panel comprises a bottom surface at least partially provided with non-repositionable adhesive and a top surface devoid of adhesive; the closing panel comprises a bottom surface at least partially provided with non-drying repositionable adhesive, a top surface devoid of adhesive, and a gripping tab devoid of adhesive; the bottom surface of the closing panel is superposed on the top surface of the frame panel and the bottom surface of the frame panel is superimposed on the stiffening element at the extraction opening.

In this way, it is possible to fasten the closing panel on the frame panel inexpensively and in a removable manner and the frame panel on the stiffening element inexpensively and in a firm manner. The opening system is, therefore, firmly fastened to the stiffening element however allowing the access to the extraction opening by means of the movement of the closing panel.

Preferably, the extraction opening is made by partially or entirely removing the wrapping material from the top surface, and the opening system entirely covers the extraction opening. Even more preferably, the extraction opening is made by further removing at least partially the wrapping material from the front surface in continuity with the wrapping material removed from the top surface, and the frame panel entirely covers the extraction opening. Even more preferably, the frame panel is provided with an opening or with a movable portion or with a removable portion at the extraction opening.

In this way, the closing panel allows direct access to the group of cigarettes.

Preferably, the inner envelope is partially or entirely made of a material permeable to fluids. More preferably, the inner envelope is partially or entirely made of paper material.

In this way, the package unit cost is reduced by the use of lower cost wrapping material compared to the known thermoplastic materials used to produce reclosable packages.

Preferably, the stiffening element is a container having a parallelepiped shape enclosing the envelope and comprising a front wall, a rear wall, a top wall, a bottom wall and two side walls, the container is provided with an access opening to the envelope made partially or entirely by removing the wrapping material from the top wall at the extraction opening, and the opening system is fastened to the container by firmly superimposing the frame panel on at least two opposite walls of the container and at the access opening.

In this way, the reclosable opening system is placed directly on the outer container simplifying the packing operations.

Preferably, the access opening is made by entirely removing the wrapping material from the top wall, and the opening system is fastened to the container by firmly superimposing the frame panel on two opposite walls of the container, the opening system covers the extraction opening and defines entirely the top wall. In particular, the opening system is fastened to the container by firmly superimposing the frame panel on at least the front and rear walls of the container. Even more preferably, the access opening is made by further removing at least partially the wrapping material from the front wall in continuity with the portion removed from the top wall, and the opening system is fastened to the container by firmly superimposing the frame panel on the front and rear walls of the container, the opening system covers the access opening and defines entirely the top wall.

In this way, the frame panel closes the container defining the head portion. In addition, the opening of the package is obtained by lifting the closing panel with respect to the frame panel allowing access to the cigarette extraction opening.

Preferably, the container comprises two side flaps which respectively extend from the side walls and partially on the top surface, and the opening system is fastened to the container by firmly superimposing the frame panel on the side flaps and on the front and rear walls of the container. Alternatively or in addition, the container comprises a rear flap which extends from the rear wall and partially on the top surface, and the opening system is fastened to the container by firmly superimposing the frame panel on the rear flap and on the front and rear walls. Furthermore, alternatively or in addition, the container comprises two side flaps and a rear flap, the side flaps extend respectively from the side walls and partially on the top surface, the rear flap extends from the rear wall and partially on the top surface, and the opening system is fastened to the container by firmly superimposing the frame panel on the side flaps and the rear flap and on the front and rear walls. In particular, the side flaps and the rear flap are made into a single element.

In this way, the flaps allow to stiffen the positioning of the frame panel and to make it more adherent to the container. In particular, the side flaps make possible the constant coupling of the support element to the outer container by minimizing the gap portions between the two elements.

In an alternative embodiment, the package further comprises a container having a parallelepiped shape enclosing the envelope and provided with an access opening to the envelope and with a hinged lid, wherein the stiffening element is an innerframe partially wrapping the envelope and comprising at least a front panel, two side panels, and a rear panel, the innerframe is arranged at the access opening and interposed between the container and the envelope, and the opening system is fastened to the innerframe by firmly superimposing the frame panel on two opposite walls and at the access opening.

In this way, the reclosable opening system is placed directly on the innerframe and preserves the contents of the envelope even after opening the lid.

Preferably, the innerframe comprises a pair of rear panels separate and wrapping at least partially the rear surface, and the opening system is fastened to the innerframe by firmly superimposing the frame panel on the rear panels and on the front panel, the opening system entirely covers the extraction opening and the top surface. Alternatively or in addition, the innerframe comprises a pair of top panels that extend from the side panels and partially on the top surface, and the opening system is fastened to the innerframe by firmly superimposing the frame panel on the top panels, on the back panel and on the front panel, the opening system entirely covers the extraction opening and the top surface. Furthermore, alternatively or in addition, the innerframe comprises a pair of rear panels separated and wrapping at least partially the rear surface and a pair of top panels that extend from the side panels and partially on the top surface, and the opening system is fastened to the innerframe by firmly superimposing the frame panel on the rear panels, on the top panels and on the front panel, the opening system entirely covers the extraction opening and the top surface. Furthermore, alternatively or in addition, the innerframe comprises a pair of rear panels separated and wrapping at least partially the rear surface and a pair of top panels that extend from the rear panels and partially on the top surface, and the opening system is fastened to the innerframe by firmly superimposing the frame panel on the rear panels, on the top panels and on the front panel, the opening system entirely covers the extraction opening and the top surface.

In this way, the panels allow to stiffen the positioning of the frame panel and to make it more adherent to the innerframe. In particular, the rear and/or top panels make possible the constant coupling of the support element to the innerframe minimizing the gap portions between the two elements.

The purposes mentioned above are further obtained with a packing method of a package of cigarettes, according to the accompanying claims.

The packing method comprises the steps of:

feeding the group of cigarettes;

defining the soft envelope provided with an extraction opening wrapping the group of cigarettes with a sheet of wrapping material;

wrapping the stiffening element along at least two opposite surfaces of the envelope and at the extraction opening, defining the partially-wrapped package;

the method is characterized in that it comprises the step of applying the reclosable opening system to the partially-wrapped package by firmly superimposing the frame panel on at least two opposite walls of the stiffening element and at the extraction opening.

In this way, it is possible to use less complex wrapping processes to define a partially-wrapped package and then apply, for example, by means of one or more labelers, the reclosable opening system to the aforesaid partially-wrapped package.

Preferably the step of applying the opening system comprises:

coupling and firmly fastening the frame panel on at least two opposite walls of the stiffening element and at the extraction opening, and subsequently detachably coupling the closing panel on the frame panel by closing the extraction opening.

Alternatively, the step of applying the opening system comprises:

detachably coupling the closing panel on the frame panel, and subsequently coupling and firmly fastening the frame panel on at least two opposite walls of the stiffening element and at the extraction opening.

BRIEF DESCRIPTION OF THE DRAWINGS

Further characteristics and advantages of the present invention will become apparent from the description of preferred embodiments, illustrated by way of non limiting example in the accompanying figures, wherein.

PREFERRED EMBODIMENTS OF THE INVENTION

Figure 1:
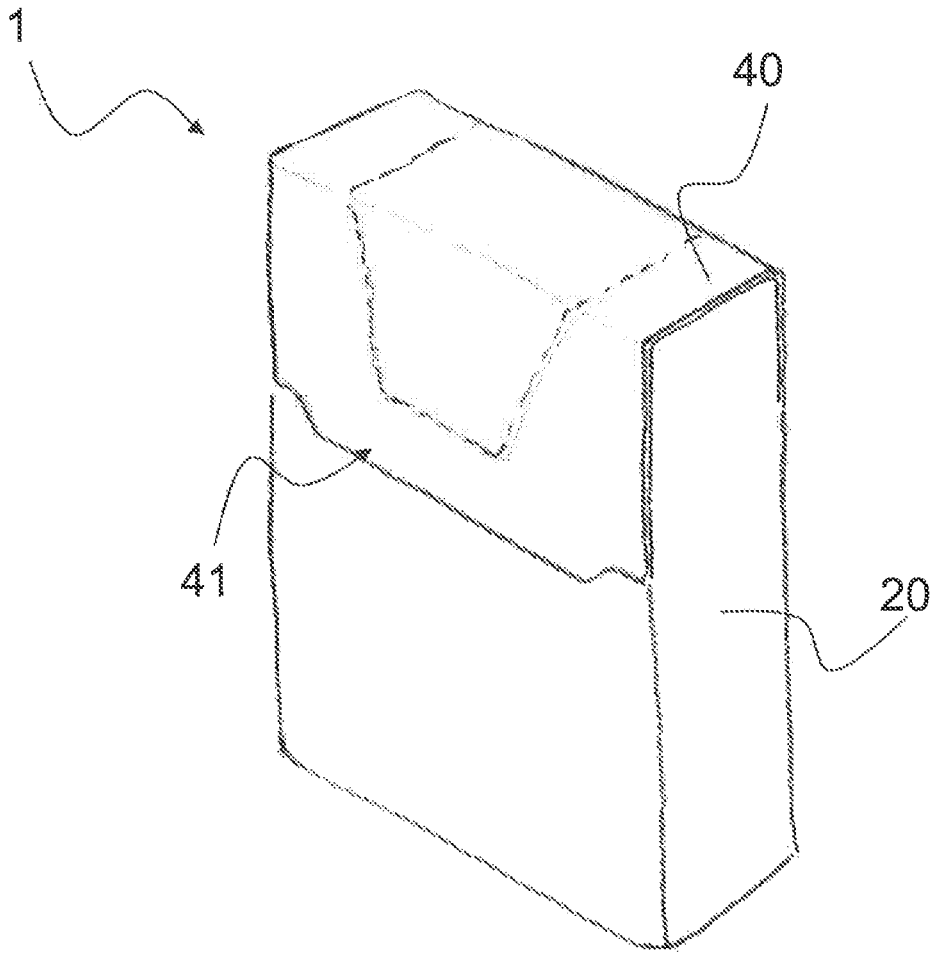
FIG. 1 is a front perspective view of a first embodiment of the reclosable package of cigarettes, according to the present invention, when the closing panel is in the closing position, superimposed on the frame panel.
Figure 2:
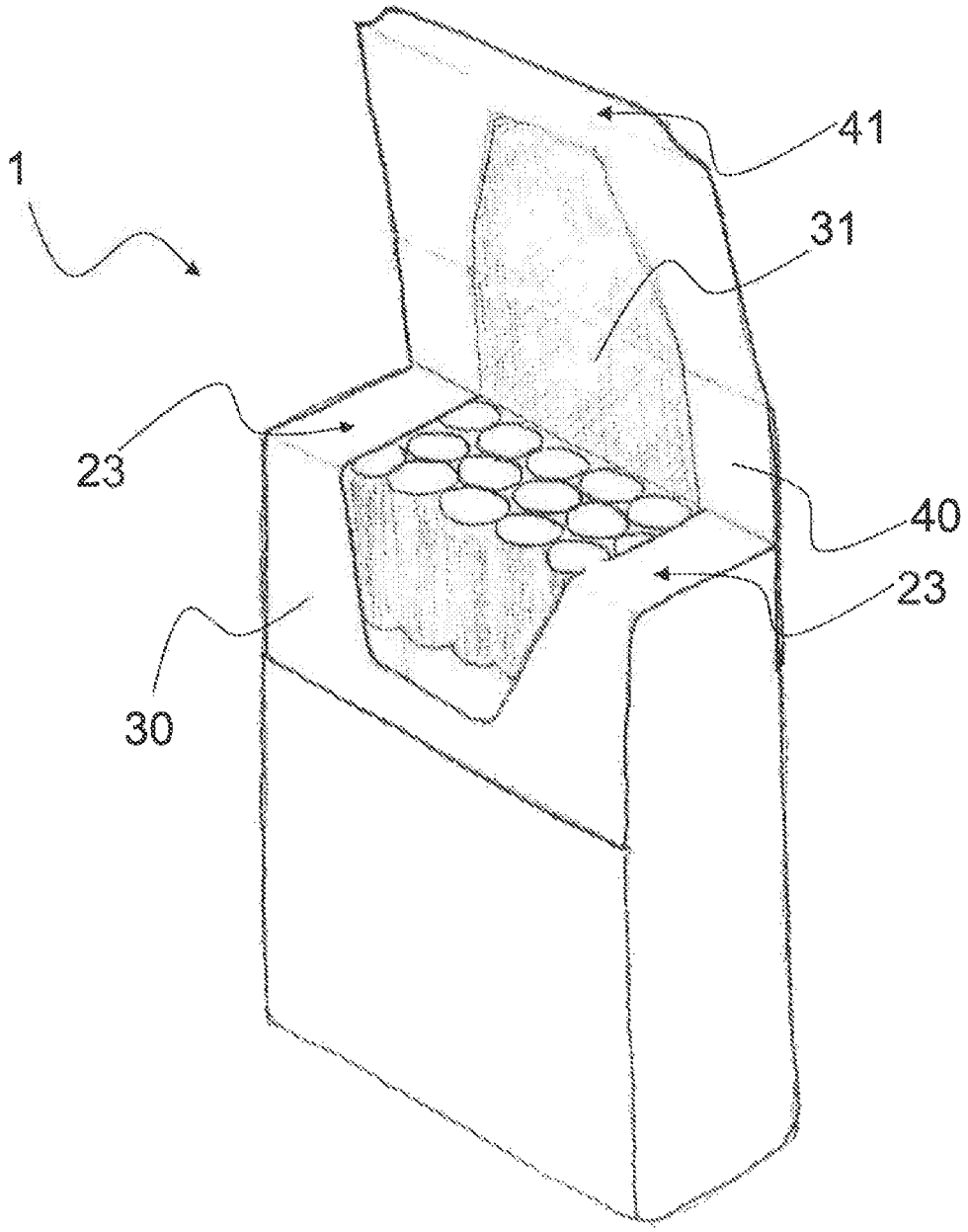
FIG. 2 is a front perspective view of the package of cigarettes of FIG. 1, when the closing panel is in the opening position, partially lifted with respect to the frame panel.

With reference to FIGS. 1 and 2, a resealable type package 1 of cigarettes is illustrated, according to the present invention.

Figure 3:
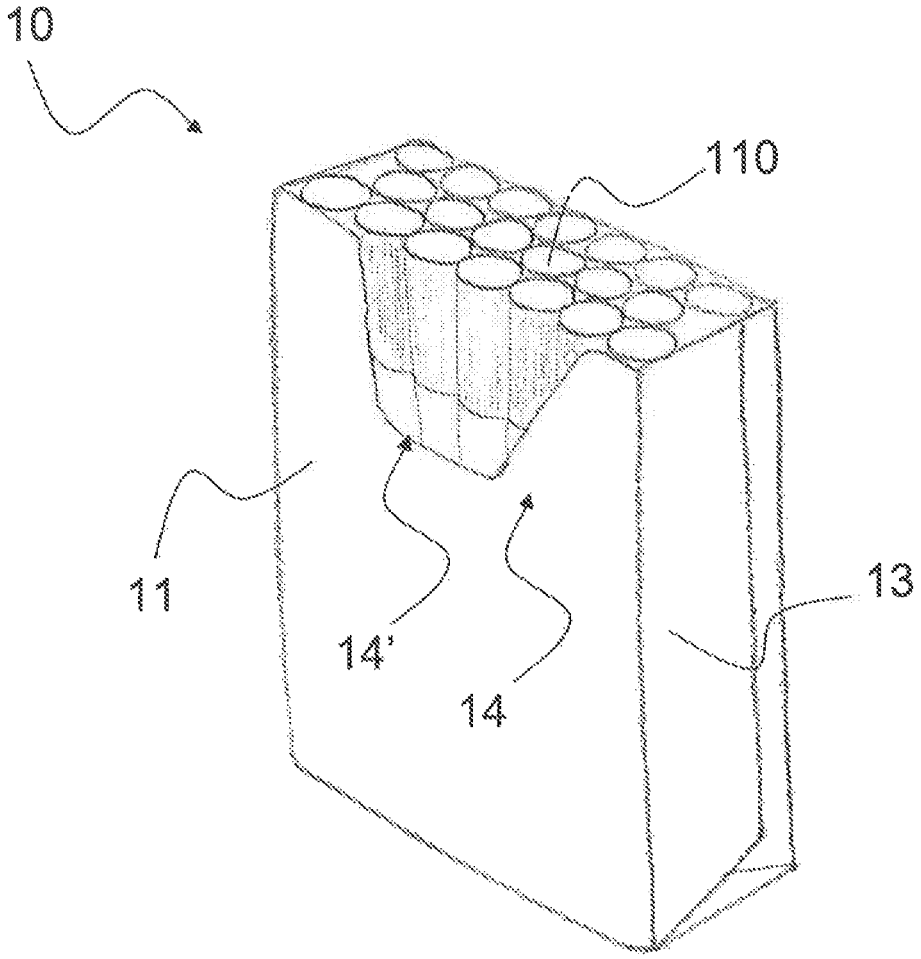
FIG. 3 is a front perspective view of the envelope enclosing the group of cigarettes of the package of FIG. 1.

The package 1 comprises a soft envelope 10 which encloses a group 110 of cigarettes. As illustrated in FIG. 3, the envelope 10 is defined by a piece of tape of wrapping material wrapped around the group of cigarettes 110. The wrapping and the arrangement of the layers of cigarettes allows to obtain a substantially parallelepiped shape for said envelope 10, which comprises a front surface 11, a rear surface (not shown), a top surface, a bottom surface (not shown) and two side surfaces 13. The piece of tape of wrapping material used for wrapping is preferably made of paper or partially paper material, for example comprising an outer portion at least partially metallized, and an inner at least partially paper portion. The structure of the piece makes, therefore, the envelope 10 partially or entirely permeable to fluids. In this way, the envelope 10 is suited to absorb or to enable spreading through the same of any fluid substances deposited on its surfaces, such as for example water-based adhesives or the like.

The extraction of the cigarettes 110 is made possible by an extraction opening 14 with which the envelope 10 is provided. In the embodiment described therein, said extraction opening is obtained at the filtering portion 110 of the group of cigarettes. In particular, the extraction opening 14 is made by entirely removing the wrapping material from the top surface of the envelope 10, uncovering all of the filters of the group 110. Similarly, the opening may be formed at the tips of the cigarettes. To improve the grip of cigarettes, the extraction opening 14 has a further wrapping material removed from the front surface 11, in continuity with the wrapping material removed from the top surface. In particular, the extraction opening 14 is expanded, with respect to the removal of the top surface, by forming a recess 14' on the front surface 11.

The removal of the wrapping material obtained by means of the recess 14' is contiguous with the removed top surface so as to increase the gripping area available to the user.

In a further embodiment (not illustrated), the extraction opening can be made by removing only a limited portion of wrapping material from said surface, maintaining covered part of the group of cigarettes.

Additionally in a further embodiment (not illustrated), the recess obtained by removing part of the front surface, and/or part of the top surface, can be obtained in an offset position with respect to the central axis of the same front surface. This allows, for example, to arrange the gripping area at one end of the package rather than in the traditional central position, uncovering only the cigarettes at the aforesaid end.

The package 1 further comprises a stiffening element wrapping the envelope 10 along at least two mutually opposite surfaces of the same and at the extraction opening. In particular, said stiffening element is a container 20 which also has a parallelepiped shape enclosing the envelope 10, illustrated in FIG. 4. The container 20 is obtained by folding a blank having a parallelepiped shape around said envelope 10. In the embodiment described therein, the container 20 comprises, therefore, a front wall 21, a rear wall (not illustrated), a top wall, a bottom wall (not illustrated) and two side walls 23.

The blank forming the container 20 is preferably made of a more rigid paper material with respect to the envelope 10, i.e. with greater basis weight. In particular, the blank 20 defines a container commonly identified as "soft-rigid". Said container 20 constitutes, therefore, the stiffening element of the same envelope 10, allowing a better protection of the group 110 of cigarettes from mechanical stress and external agents.

The access to the extraction opening 14 of the envelope 10 and, consequently, to the group 110 of cigarettes, is granted by means of an access opening 24 provided by the container 20. In particular, the container 20 is devoid of the wrapping material of the top wall and has further wrapping material removed from the front wall 21, in continuity with the wrapping material removed from the top wall. In particular, the access opening 24 is expanded, with respect to the removal of the top wall, defining a front opening 24' on the front wall 21 contiguous to the top wall. As previously described for the envelope 10, therefore, the top wall and the front opening 24' define the access opening 24 which extends over a large gripping area made available to the user.

Figure 4:
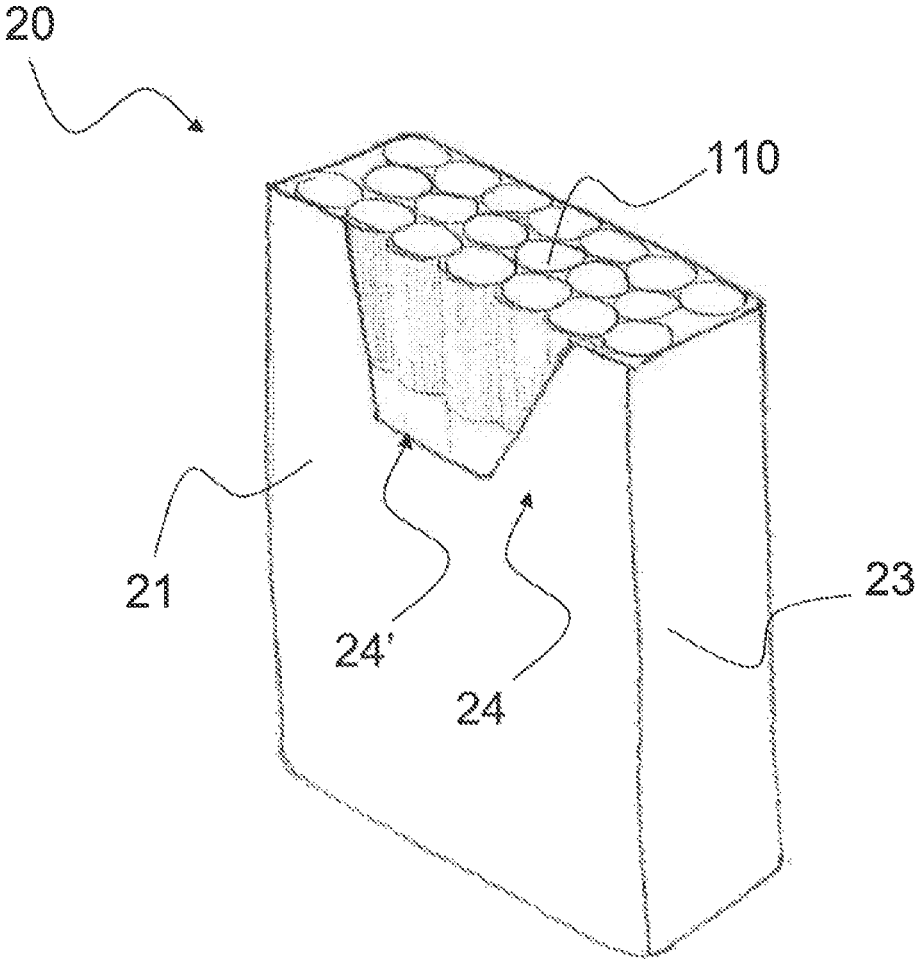
FIG. 4 is a front perspective view of the container enclosing the envelope of FIG. 3.

The access opening 24, therefore, corresponds with the extraction opening 14, thus entirely masking the presence of the envelope 10, as illustrated in FIG. 4.

As previously described with reference to the envelope 10, in further embodiments (not illustrated), the access opening can be obtained by removing only a portion of the wrapping material from the top wall. In addition, the recess obtained by removing part of the front wall can be formed in an offset position with respect to the central axis of the same.

Figure 5A:
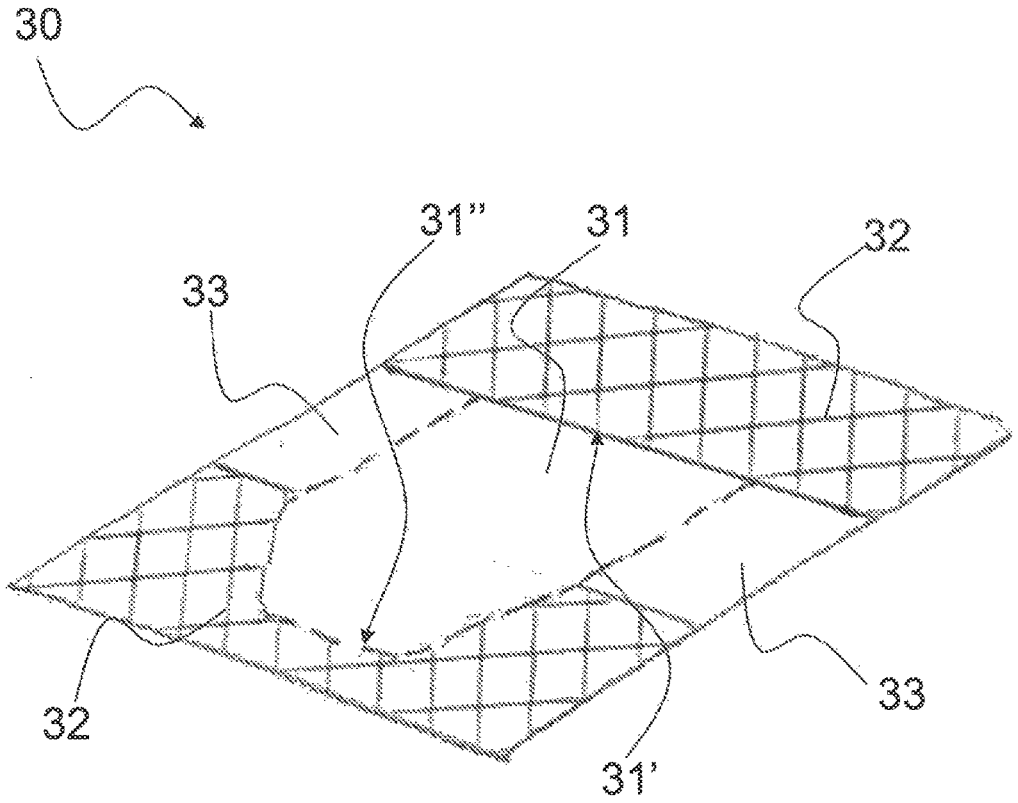
FIG. 5A is a bottom perspective view of the frame panel of the package of FIG. 1, in extended configuration.
Figure 6A:
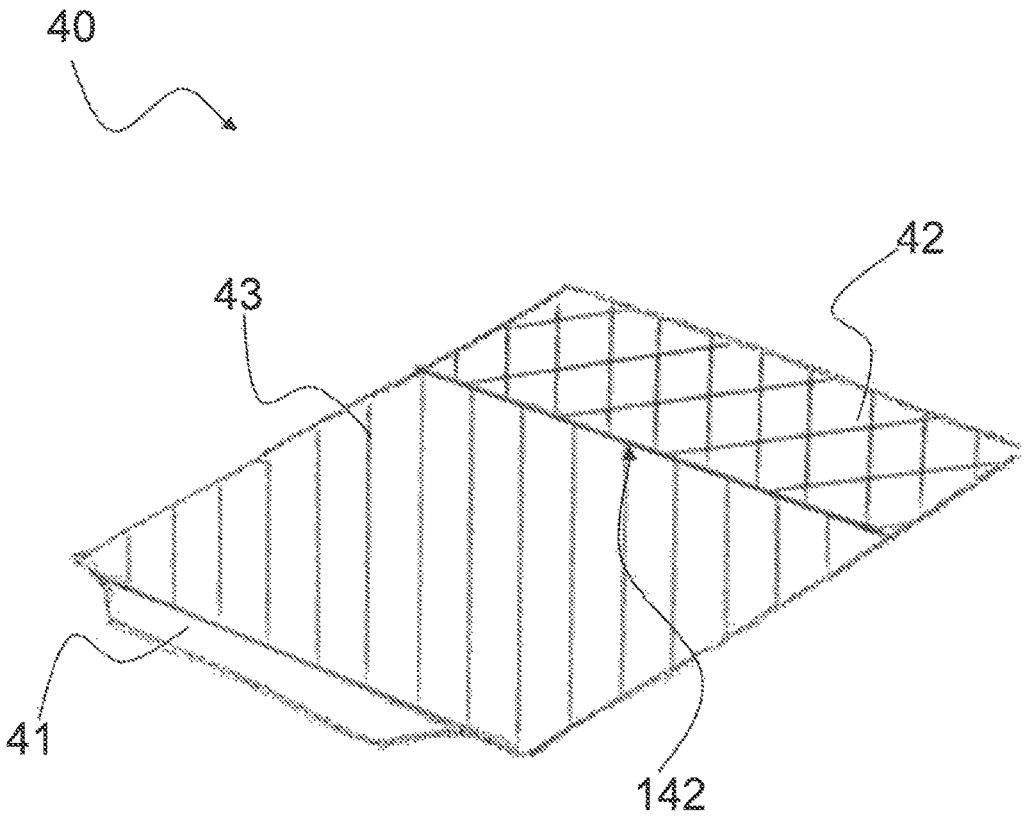
FIG. 6A is a perspective view from below of the closing panel of the package of FIG. 1, in the extended configuration.
Figure 6B:
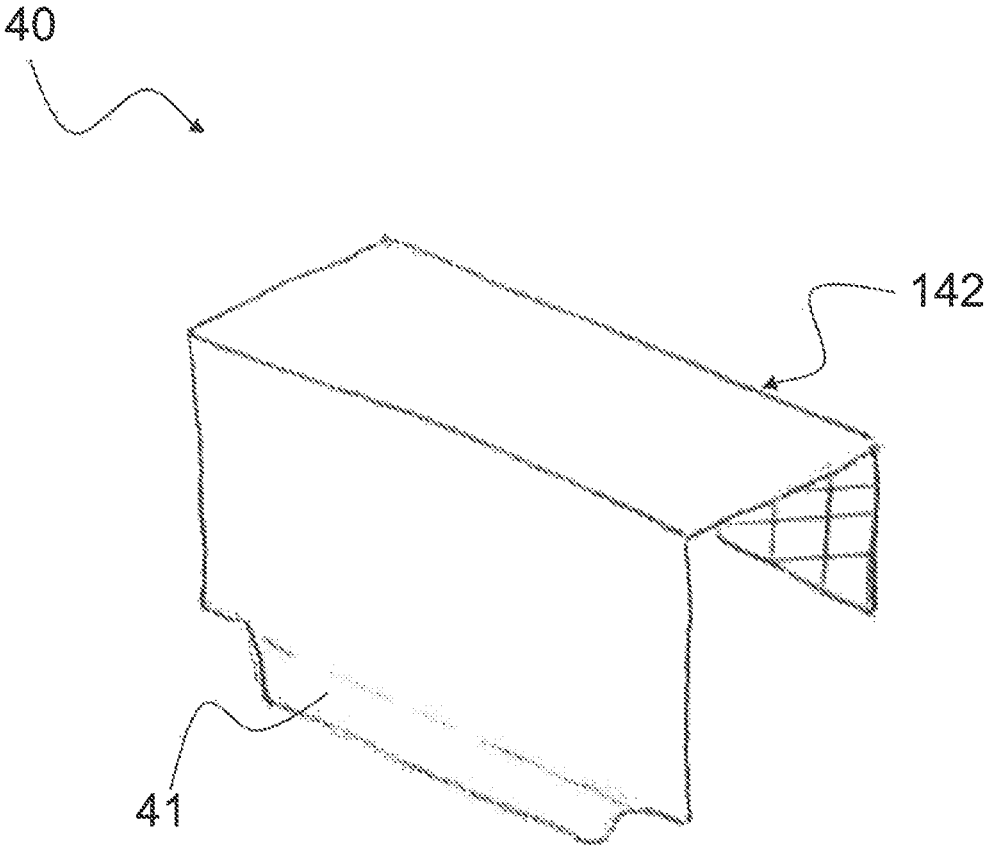
FIG. 6B is a perspective view from above of the closing panel of FIG. 6A in the folded configuration.
Figure 7:
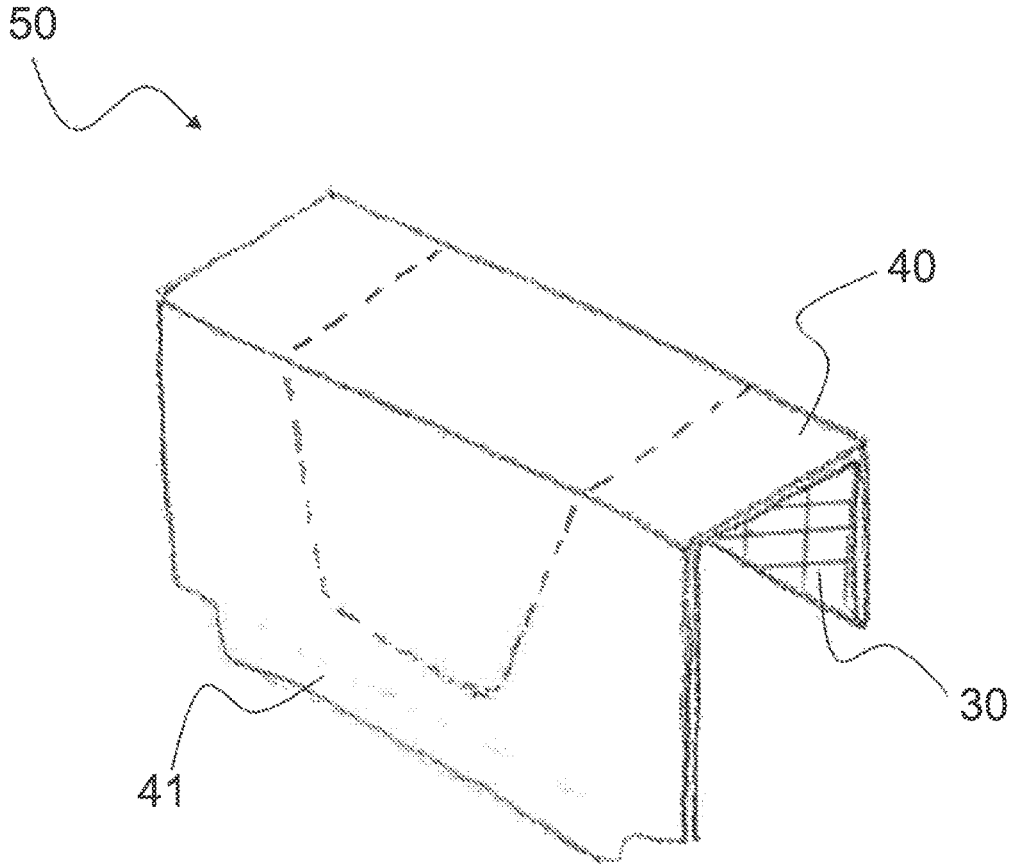
FIG. 7 is a top perspective view of the reclosable opening system obtained by superimposing the closing panel of FIGS. 6A-6B on the frame panel of FIGS. 5A-5B in folded configuration.

The covering of the access opening 24 and, in a corresponding manner, of the extraction opening 14 is obtained by coupling a reclosable opening system 50, to the container 20, which defines the stiffening element, illustrated in FIG. 7. Said reclosable opening system 50 is constituted by an adhesive closing panel 40, illustrated in FIGS. 6A-6B, superimposed in a removable manner on an adhesive frame panel 30, illustrated in FIGS. 5A-5B.

In particular, the opening system 50 is fastened to the stiffening element by firmly superimposing said frame panel 30 on at least two opposite walls of the stiffening element and at the extraction opening, as described in detail hereinafter.

Each of said panels 30, 40 comprise two opposite surfaces defined as bottom surface and top surface, with reference to the arrangement of the surfaces after coupling with the package 1. In the preferred embodiment, the frame panel 30 comprises a bottom surface at least partially provided with non-repositionable adhesive and a top surface devoid of adhesive. In addition, the closing panel 40 comprises a bottom surface at least partially provided with non-drying repositionable adhesive, a top surface provided with adhesive and a gripping tab 41 devoid of adhesive. Both of the above panels 30, 40 have, therefore, preferably a label shape wherein a surface is provided at least partially with adhesive and the opposite surface is entirely devoid of adhesive.

The frame panel 30 preferably has a substantially rectangular shape and dimensions such as to extend between the two opposite walls of the container 20, defining the stiffening element, on which is firmly superimposed. The reclosable opening system 50 is fastened to the container 20 by firmly superimposing the frame panel 30 on at least two opposite walls of the container 20 and at the access opening 24. In the preferred embodiment, the above opening system 50 is fastened to the container 20 by firmly superimposing the frame panel 30 at least on the front and rear walls of the same container 20. In particular, the bottom surface of the frame panel 30 is superimposed to the stiffening element at the extraction opening 14. The firm coupling is, therefore, defined by the non-repositionable adhesive with which said bottom surface is provided in contact with the walls of the container 20, as hereinafter described in detail. As shown in FIGS. 1 and 2, the frame panel 30 is in fact rigidly coupled to the container 20 on the front 11 and rear walls covering the access opening 24 and, consequently, the extraction opening 14. In particular, said frame panel 30 covers the extraction opening 14 and entirely defines the top wall 23 of the container 20 devoid of wrapping material. To access the access opening 24 and, consequently, the extraction opening 14, the frame panel 30 is provided with a movable portion 31 placed at the same access opening 14. The movable portion 31 is partially separated from the remaining portions constituting the frame panel 30, by means of suitable dashed cuts 31" made along the perimeter of the same, and is hinged along a hinge line 31' obtained at the peripheral portion without dashed cuts.

The coupling between the frame panel 30 and the container 20 is obtained at the bottom surface of the same panel 30 (illustrated in the top surface in FIG. 5A) which is provided with non-repositionable adhesive in a first coupling portion 32 and is devoid of adhesive in a first contact portion with the group of cigarettes, defined by the movable portion 31, at the extraction opening 14. In the embodiment illustrated in FIGS. 5A and 5B, the frame panel 30 further comprises two side portions 33 devoid of adhesive. The above are arranged at the ends of the movable portion 31 at the extraction opening 14, therefore in contact with the filtering portion 110 of the group of cigarettes. Alternatively, said frame portions 33 could be inerted, despite being provided with adhesive (for example, by coupling a further layer of material devoid of adhesive to the same) to prevent the group 110 of cigarettes from being contaminated by the adhesive during the contact with the bottom surface of the frame panel 30.

Figure 5B:
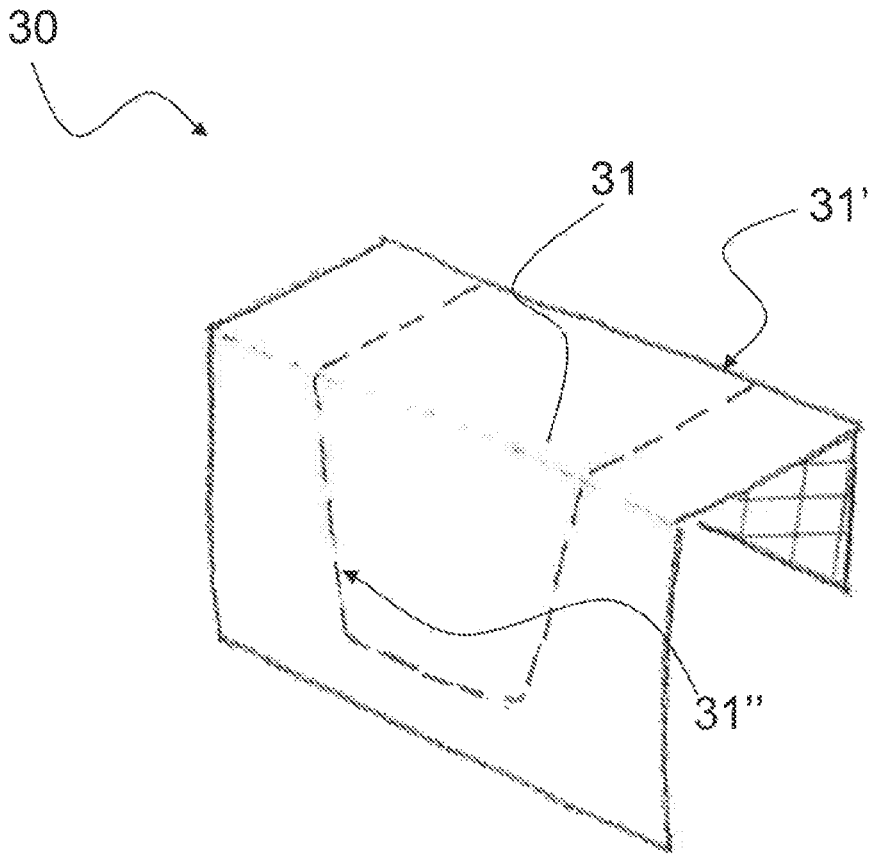
FIG. 5B is a perspective view from above of the frame panel of FIG. 5A in folded configuration.

The top surface of the frame panel 30, arranged in opposite position with respect to the group 110 of cigarettes, is, however, devoid of adhesive and allows to superimpe the closing panel 40. The coupling between the frame panel 30 and the container 20 is therefore stable and such as to not allow removing the panel 30 itself without damaging the container 20 to which it is fastened. In particular, the frame panel 30 is U-shaped (as illustrated in FIG. 5B) being arranged on three adjacent walls of the container 20.

According to further embodiments (not illustrated) the movable portion may be replaced by an opening, which uncovers the filtered portion 110 of the group of cigarettes, or with a portion removable by the user at the first opening.

The closing panel 40 also has a substantially rectangular shape and dimensions such as to exactly cover the frame panel 30 extending between two opposite walls of the container 20. As illustrated in FIGS. 1 and 2, also the closing panel 40 is coupled to the container 20 on the front and rear walls 11 covering the access opening 24 and, consequently, the extraction opening 14. The coupling to the container 20 is made by interposing the frame panel 30 between the container 20 itself and the closing panel 40. In particular, the bottom surface of the closing panel 40 is superposed on the top surface of the frame panel 30. Said closing panel 40 is thus suited to cover and close the access opening 24 and, consequently, the extraction opening 14. In particular, the re-closing of the extraction opening 14 is obtained even after the first opening and after detaching or removing the movable portion 31.

Also the closing panel 40 entirely covers the access opening 24 and the top wall 23 of the container 20. To allow access to the access opening 24 and, consequently, to the extraction opening 14, the closing panel 40 is movable between an opening position, in which it is at least partially detached from the frame panel 30 to access the extraction opening 14, and an opening position, in which it is superimposed on the frame panel 30 closing the extraction opening 14. Usually, said closing panel 40 is in the closing position of the extraction opening 14 and is temporarily lifted by the user in the opening position for extracting the cigarettes through the opening 14 itself.

The integral coupling between the two panels 30, 40 is obtained at a coupling portion 42 placed on the bottom surface of the closing panel 40 (illustrated as top surface in FIG. 6A). Said coupling portion 42 is provided with a non-repositionable adhesive and is arranged at the portion of the closing panel 40 which is superimposed on the rear wall of the container 20. The remaining covering portion 43 is instead provided with non-drying repositionable adhesive to enable coupling with and decoupling from the frame panel 30 on which it is superimposed.

The closing panel 40, according to the present invention, is further provided with a gripping tab 41, as previously described. In particular, said gripping tab 41 is a portion protruding from the coupling portion 42 and devoid of adhesive. This allows the user to hold the same avoiding the deposition of adhesive on the skin. In the embodiment illustrated in FIGS. 6A and 6B, the gripping tab 41 and the closing panel 40 are made in a single element, since the gripping tab 41 is a portion of the closing panel 40 to which adhesive has not been applied. In this way the risk that the gripping tab 41 is detached from the panel 40 is avoided even if the latter is subjected to repeated stress for accessing the group 110 of cigarettes during the useful life of the package 1. According to further embodiments, in accordance with the present invention, the gripping tab can be also made as a separate element but integrally coupled to the closing panel.

The edge 142 which divides the coupling portion 42 from the covering portion 43 defines the hinge of the closing panel 40 and, consequently, an "open & close" type resealable sealing panel. Said panel extends on the top surface and on a portion of the front surface of the container 20. The closing panel 40 is, therefore, U-shaped (as illustrated in FIG. 6B) being arranged on three adjacent walls of the container 20. In particular, as illustrated in FIG. 7, the two panels 30, 40 are superimposed so as to leave only the gripping tab 41 free from being superimposed to facilitate user access.

The arrangement of the two panels 30, 40 on the container 20 allows to obtain a package provided with a reclosable opening system 50 even in the case of substantially paper material both for the container 20 and for the envelope 10. The panels 30, 40 are, in fact, preferably at least partially made of a material not permeable to fluids, or such as to not allow the non-repositionable adhesive to dry.

In use, at the first opening, the user lifts the panel 40 acting by means of the gripping tab 41. The lifting allows, therefore, to rotate the panel 40 with respect to the hinge 142. The coupling defined between the bottom surface of the panel 40 and the corresponding top surface of the frame panel 30 allows to lift at the same time also the movable portion 31 to uncover the extraction opening 14 of the group 110 of cigarettes. In particular, the adhesion between the two panels 30, 40 is such so as to tear the movable portion 31 at the dashed cuts 31" made along the perimeter of said portion 31, when the closing panel 40 is lifted to uncover the extraction opening 14.

Figure 8A:
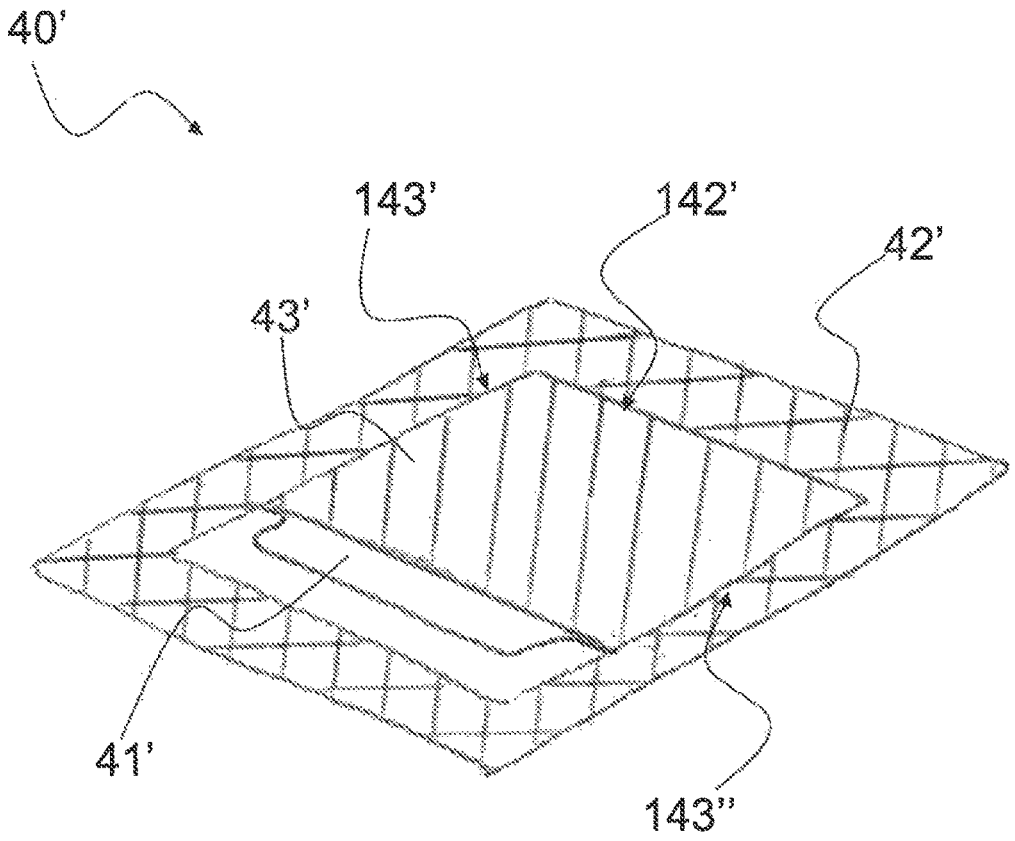
FIG. 8A is a perspective view from below of a second embodiment of the closing panel, in extended configuration.
Figure 8B:
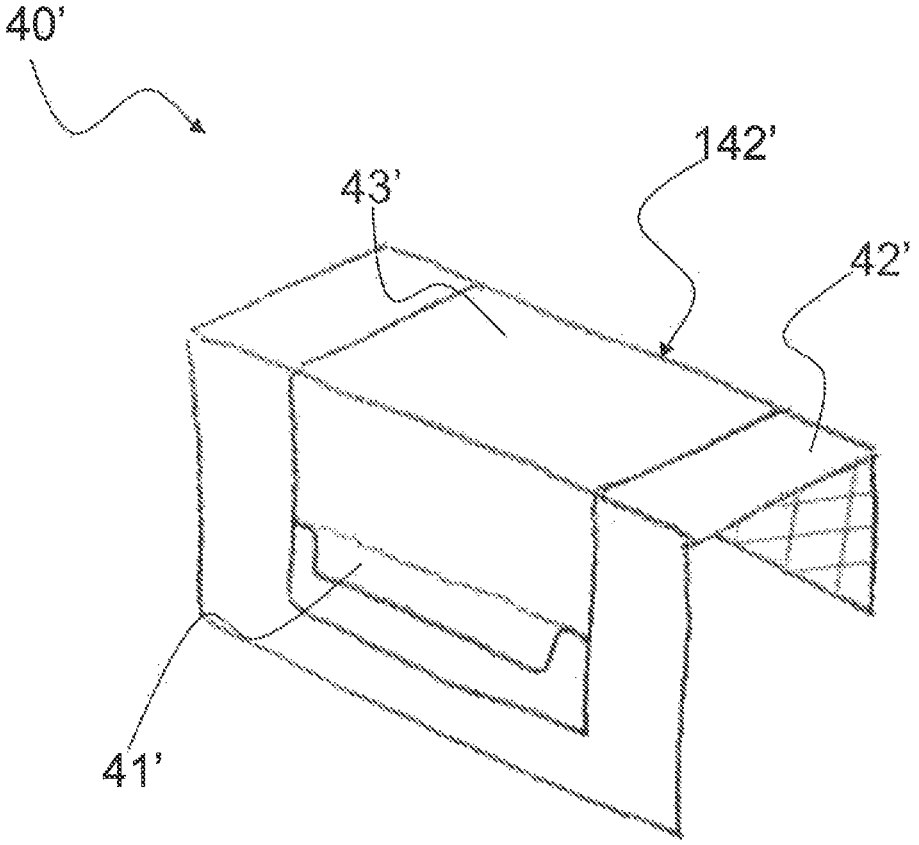
FIG. 8B is a perspective view from above of the closing panel of FIG. 8A in folded configuration.
Figure 9:
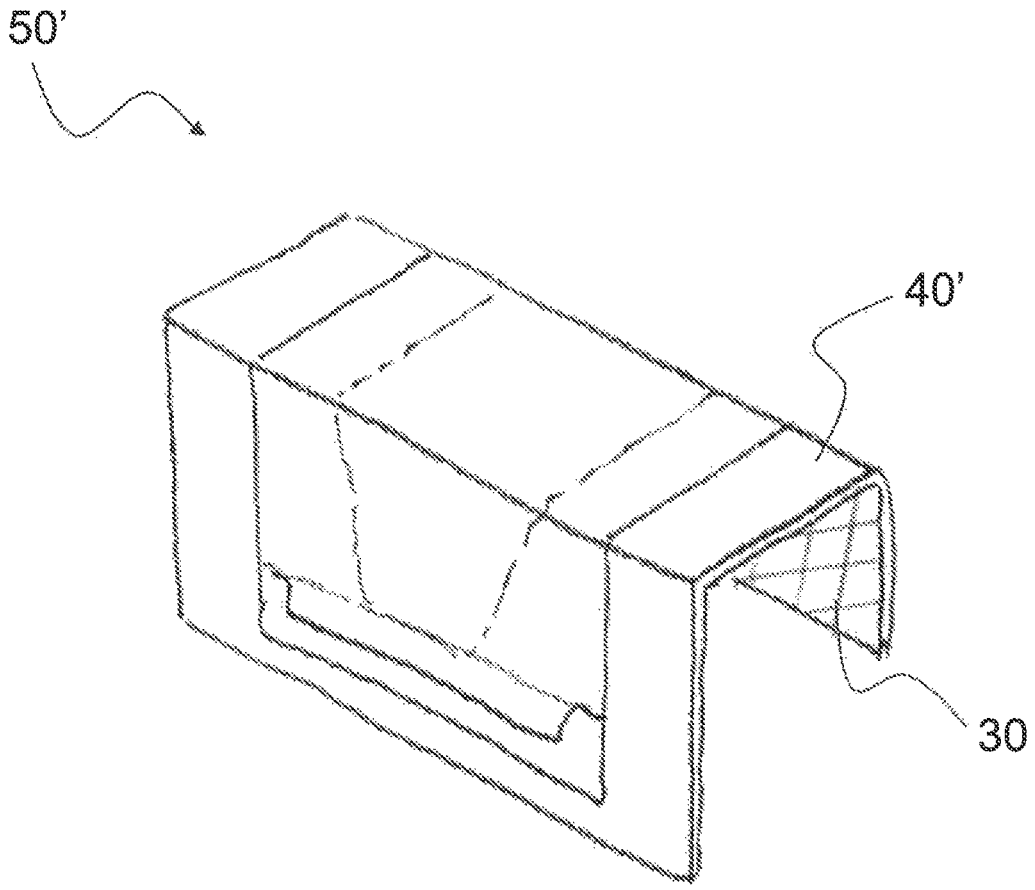
FIG. 9 is a top perspective view of a second embodiment of the reclosable opening system obtained by superimposing the closing panel of FIGS. 8A-8B on the frame panel of FIGS. 5A-5B in folded configuration.

A second embodiment of the reclosable opening system 50' is illustrated in FIG. 9 and comprises, in particular, the aforesaid frame panel 30 and a second embodiment of the closing panel 40', as illustrated in FIGS. 8A and 8B. The coupling portion 42', provided with non-repositionable adhesive, extends along the entire perimeter of the closing panel 40' defining an adhesion frame to the underlying frame panel 30. Both the covering portion 43' and the respective gripping tab 41' are made within the coupling portion 42'. In particular, the covering portion 43' is separated from the frame 42' by two cutting lines 143', 143" opposite to each other and by the portion which defines the gripping tab 41'. A hinge line 142 solidly connects the covering portion 43' to the coupling portion 42' defining an "open & close" type resealable sealing panel. The gripping tab 41' is formed by removing a portion of the closing panel 40', defining an element that can be held by the user and is devoid of adhesive. In FIG. 9 it is thus visible the second embodiment of the reclosable opening system 50' formed by the frame panel 30, previously described and illustrated in FIGS. 5A-5B, on which the closing panel 40' is superimposed, according to the second embodiment illustrated in FIGS. 8A-8B.

In use, as described above for the actuation of the first embodiment the reclosable opening system 50 remains valid, mutatis mutandis, for said second embodiment.

Figure 10:
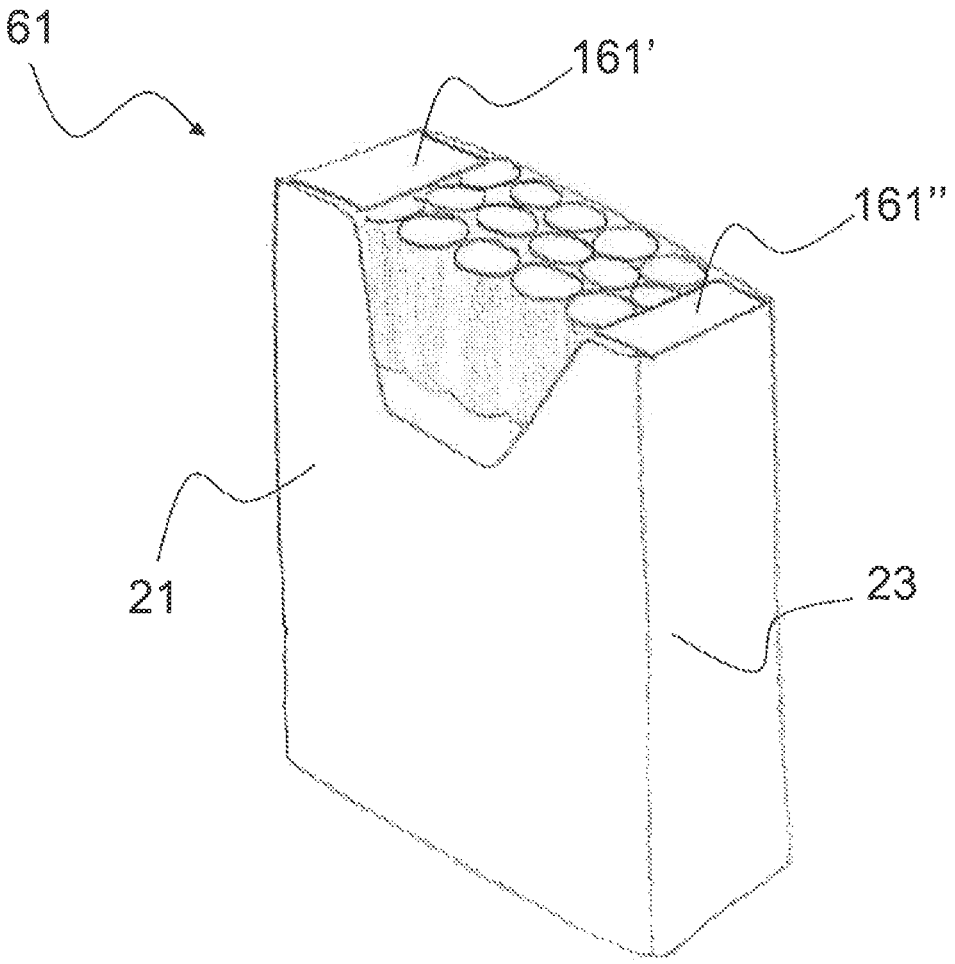
FIG. 10 is a front perspective view of a second embodiment of the container enclosing the envelope of FIG. 3.

A second embodiment of the package of "soft-rigid" type provides a different conformation of the stiffening element. As illustrated in FIG. 10, the container 61, defining the aforesaid stiffening element, further comprises two side flaps 161', 161" extending respectively from the side walls 23 and partially on the top surface 22. A reclosable opening system, for example according to the embodiments previously described, is therefore fastened to the container 61 by firmly superimposing the frame panel on the side flaps 161', 161" and on the front 21 and rear walls of the container. In this way, the reclosable opening system covers the access opening, and consequently, the extraction opening 14.

What has been previously disclosed for the package 1 can be applied, mutatis mutandis, to a package made with a container provided with side flaps 161', 161", as illustrated in FIG. 10.

The flaps 161', 161" allow to stiffen the positioning of the frame panel, making it more adherent to the package and, in particular, to the outer container 61. The side flaps 161', 161" allow, furthermore, the continuous coupling of the frame panel to the outer container minimizing the gap between the two elements.

Figure 11:
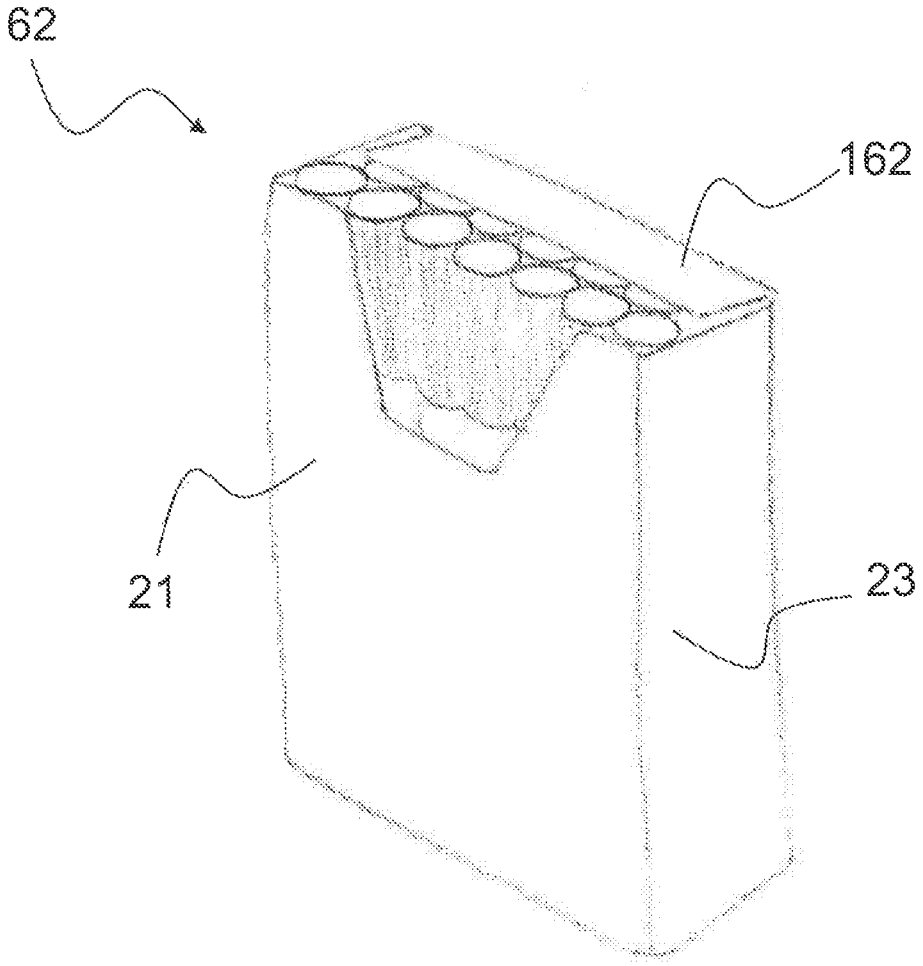
FIG. 11 is a front perspective view of a third embodiment of the container wrapping the envelope of FIG. 3.

A third embodiment of the package of "soft-rigid" type, illustrated in FIG. 11, provides that the container 62 is provided with a rear flap 162 which extends from a rear wall (not illustrated) and partially on the top surface. A reclosable opening system, for example according to the embodiments previously described, is therefore fastened to the container 62 by firmly superimposing the frame panel on the rear flap 162 and on the front 21 and rear walls (not illustrated). In this way, the reclosable opening system covers the access opening, and consequently, the extraction opening 14.

What has been previously disclosed for the package 1 can be applied, mutatis mutandis, to a package made with a container 62 provided with rear flap 162 as illustrated in FIG. 11.

As described for the second embodiment of the container 61, the rear flap 162 allows to stiffen the positioning of the frame panel, making it more adherent to the package and, in particular, to the outer container 62.

Figure 12:
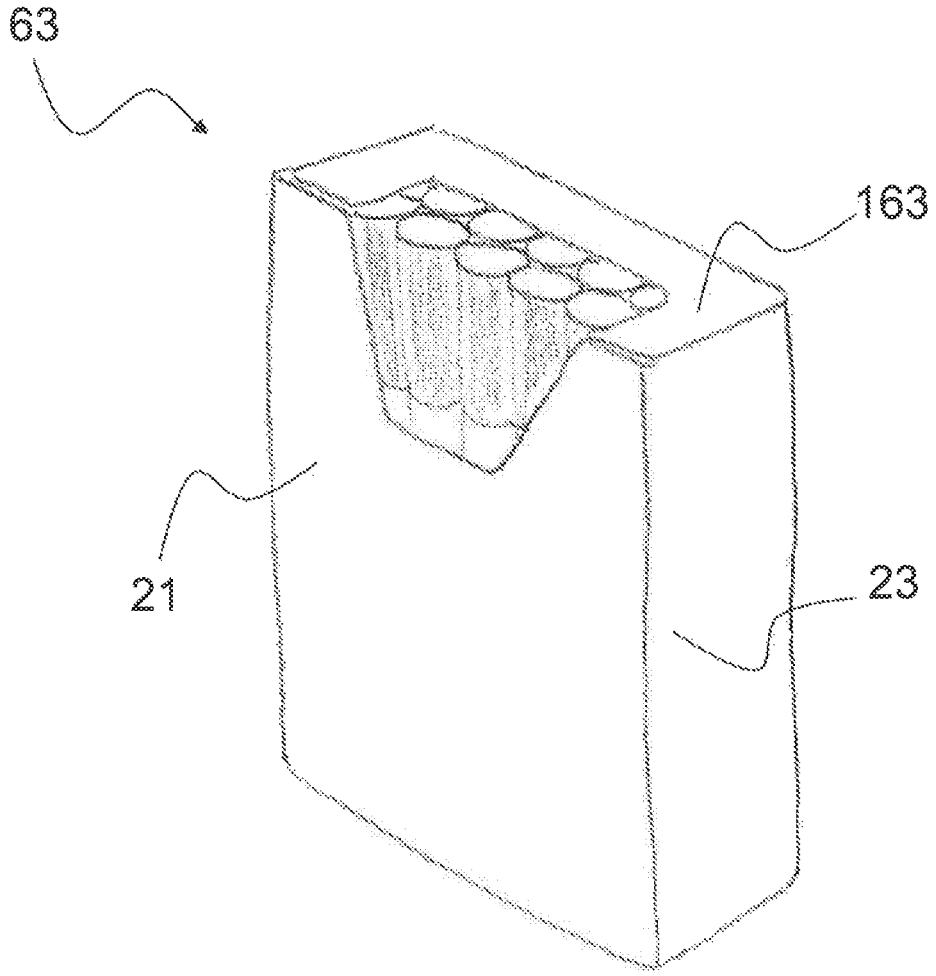
FIG. 12 is a front perspective view of a fourth embodiment of the container wrapping the envelope of FIG. 3.

In a further fourth embodiment of the package of "soft-rigid" type, illustrated in FIG. 12, the container 63 comprises two side flaps and a rear flap. Preferably, an element 163 forms in a single element the aforesaid flaps. Said element 163 extends from the rear wall (not illustrated) to the top surface. In this way, with the element 163 it is possible to circumscribe three peripheral portions of the access opening making a continuum between the four face walls of the container 63 and the top surface.

As an alternative (not illustrated), to obtain greater savings in the wrapping material defining the container, the two side flaps, which extend from the side walls 23 partially on the top surface, and the rear flap, which extends from the rear wall (not illustrated) partially on the top surface, can be made in more distinct elements. They can be partially superimposed on the top surface or can be formed so as not to obtain any superimposing configuration when arranged on the same top surface.

A reclosable opening system, for example according to the embodiments previously described, is therefore fastened to the container by firmly superimposing the frame panel on the side flaps and rear flap, or on the single element 163 forming the same, and on the front 23 and rear walls of the container.

Also for said fourth embodiment, the considerations disclosed above can be applied, mutatis mutandis, to the package 1 and the considerations relating to the container 61 provided with side flaps 161', 161" illustrated in FIG. 10.

Figure 13:
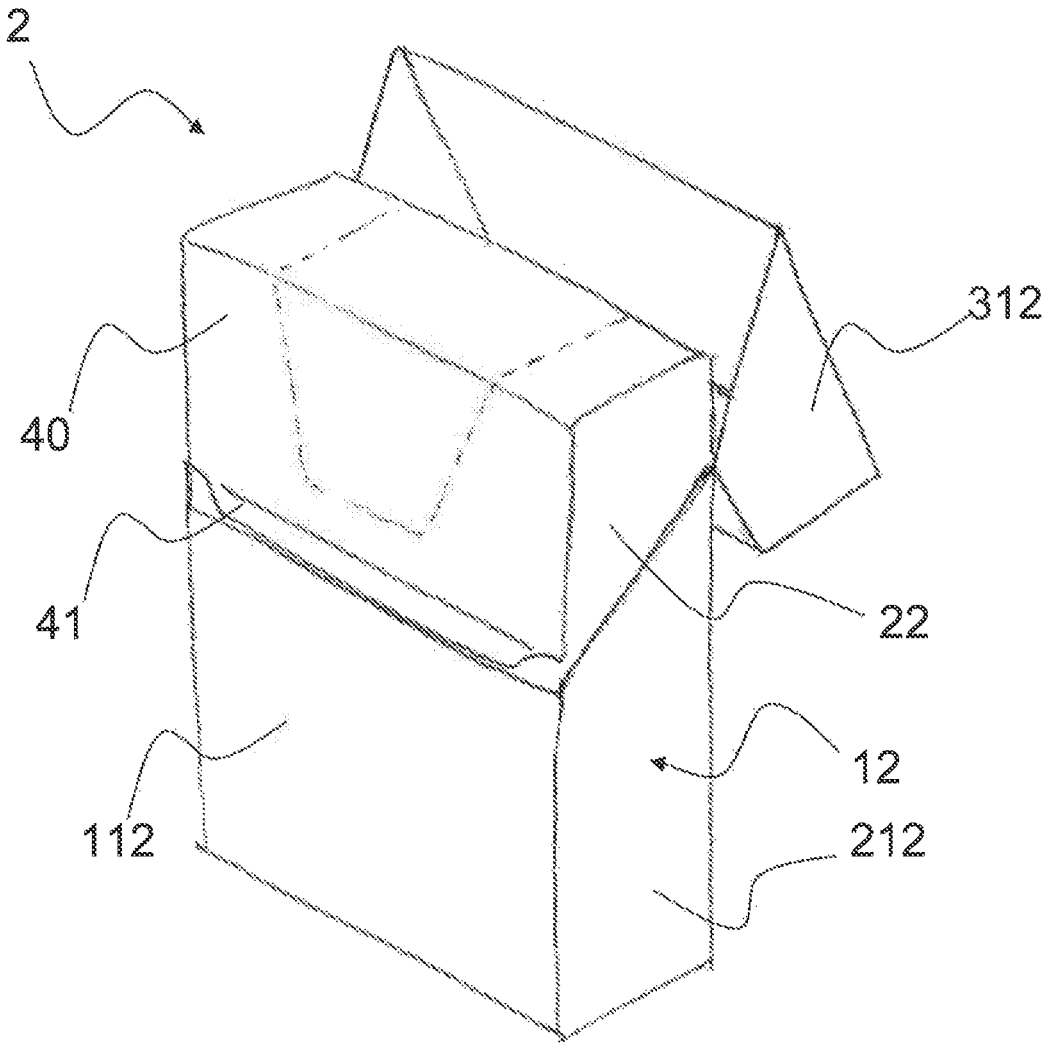
FIG. 13 is a front perspective view of a second embodiment of the reclosable package of cigarettes, according to the present invention, when the closing panel is in the closing position, superimposed on the frame panel.
Figure 14:
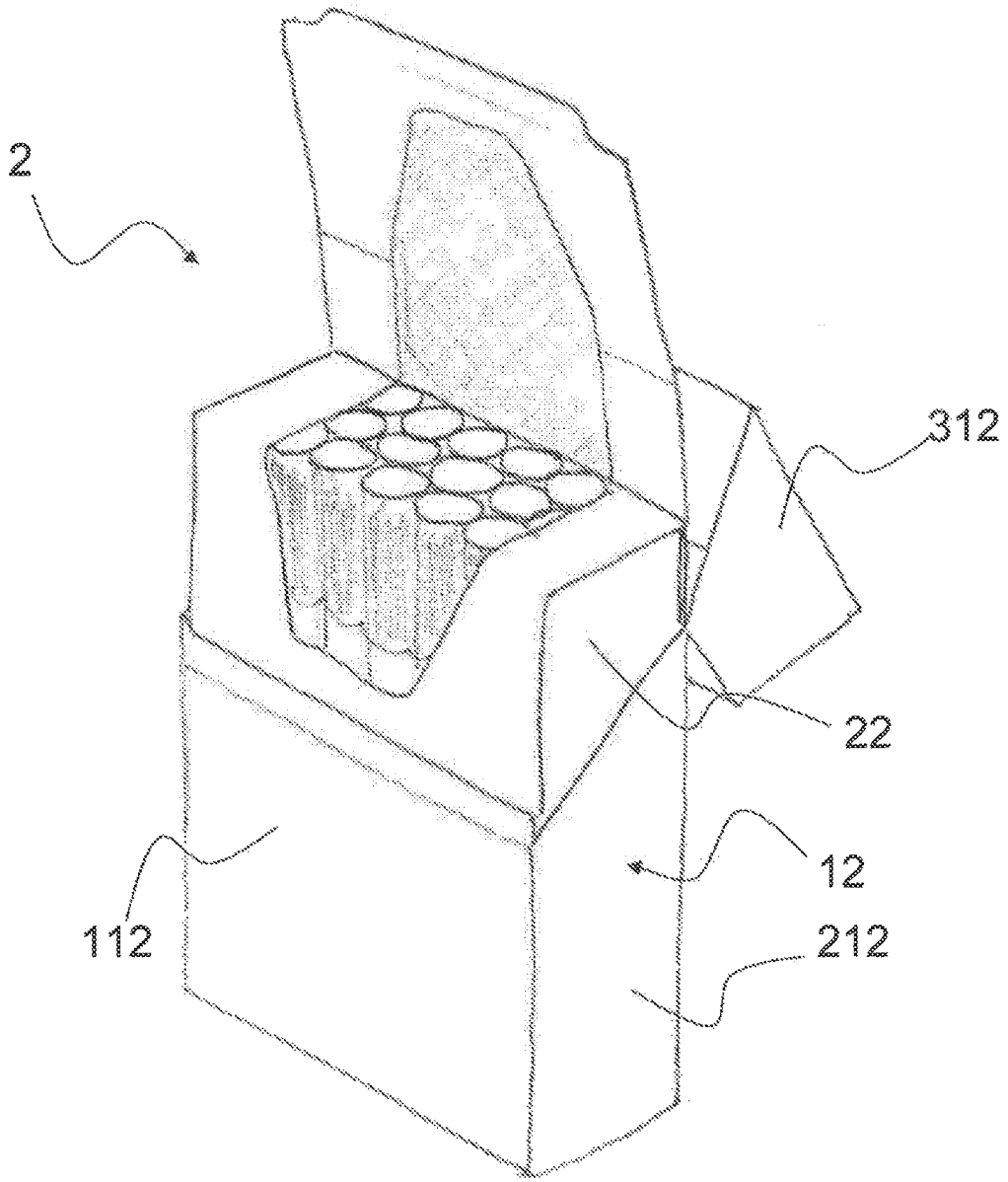
FIG. 14 is a front perspective view of the package of cigarettes of FIG. 13, when the closing panel is in the closing position, partially lifted with respect to the extraction opening.

With reference to FIGS. 13 and 14, a second embodiment of the resealable type package 2 of cigarettes is illustrated, according to the present invention. In particular, said second embodiment of the package 2 relates to a "rigid hinge-lid" type package.

The package 2 comprises a soft envelope 10 which encloses the group 110 of cigarettes. The aforementioned envelope 10 corresponds to the envelope forming the package 1 of the first embodiment (illustrated in FIG. 3), which is referred to without describing further details.

The package 2 further comprises an outer container 12 having a parallelepiped shape which encloses said envelope 10. In particular, said container 12 is obtained by folding a blank around the inner envelope 10. The container 12 comprises a front wall 112, a rear wall (not illustrated), a bottom wall (not illustrated) and two side walls 212 defining said parallelepiped structure. Finally, the outer container 12 is provided with an access opening to the envelope 10 and with a hinged lid 312 movable between an opening position and a closing position of said access opening.

The blank forming the container 12 is preferably made of a more rigid paper material with respect to the envelope 10 and to the container 20 of the first embodiment, i.e. has a higher basis weight. In particular, the blank 12 defines a container commonly identified as "rigid".

Figure 15:
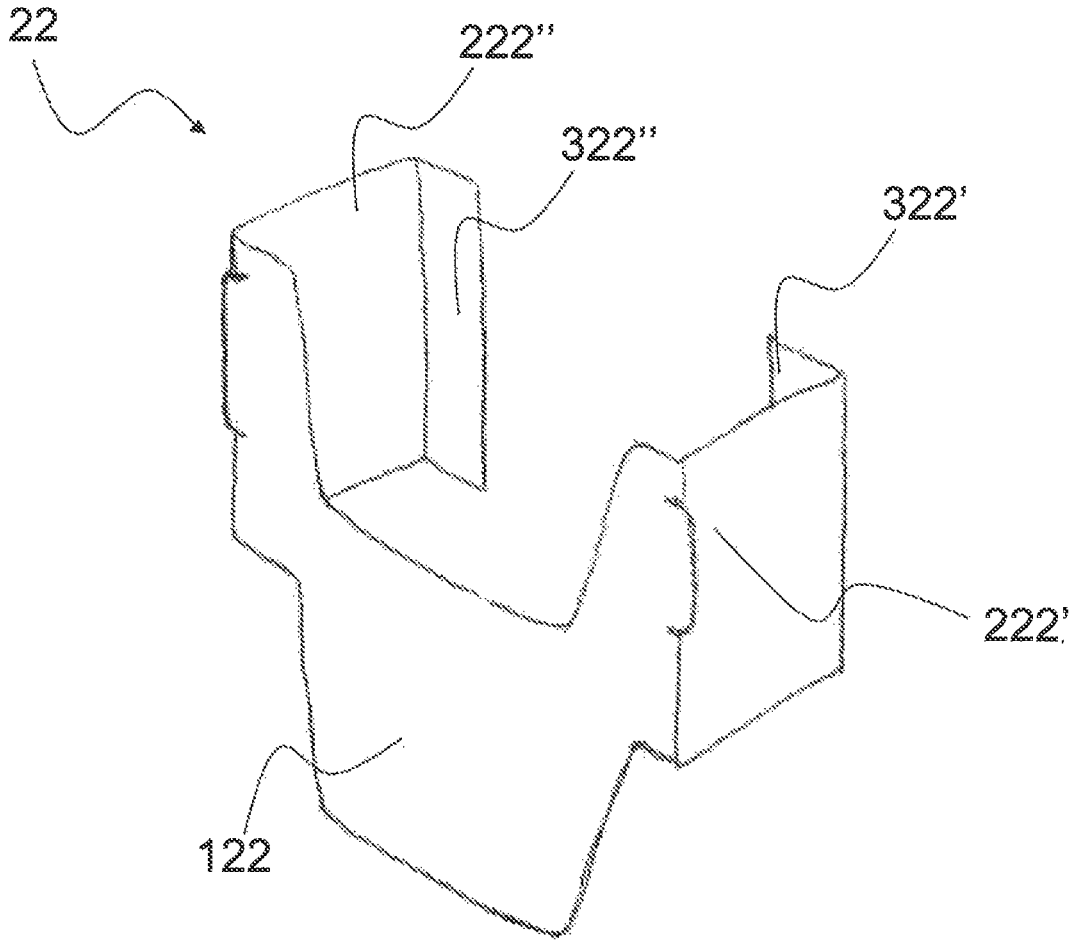
FIG. 15 is a front perspective view of a first embodiment of the innerframe of the package of cigarettes of FIG. 13.
Figure 16:
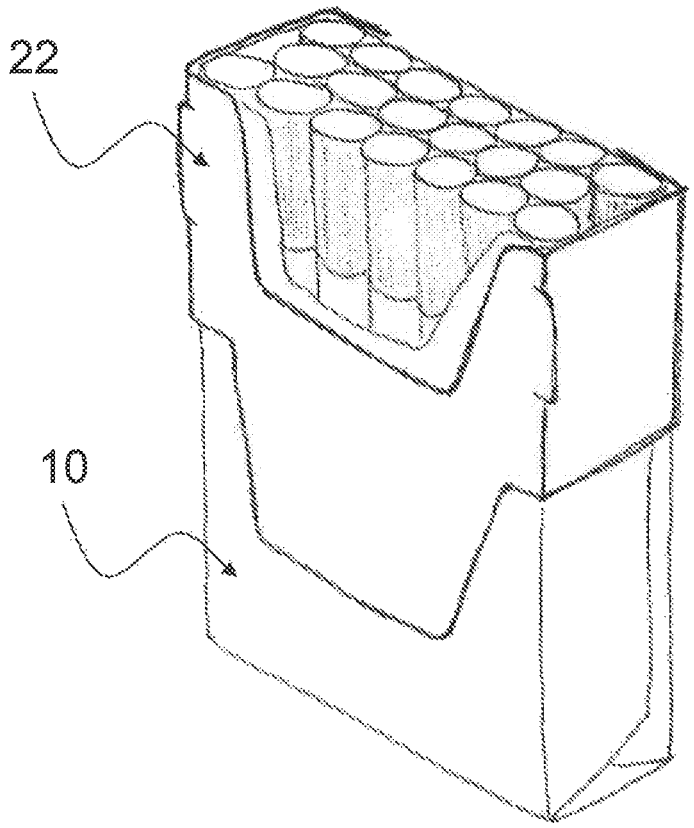
FIG. 16 is a front perspective view of the innerframe of FIG. 15 when coupled to the envelope of FIG. 3.

To increase the rigidity and allow keeping the lid 312 in the closing position, the package 2 is provided with an innerframe, illustrated in FIG. 15. The latter comprises, as known, a front panel 122 and two side panels 222', 222" and is arranged at the extraction opening, interposed between the outer container 12 and the inner envelope 10. Additionally, according to the present embodiment, the innerframe 22 comprises at least one back panel so as to wrap at least partially said envelope 10 at said extraction opening 14. In the preferred embodiment, illustrated in FIG. 15, the innerframe 22 comprises two separated rear panels 322', 322" developing from each of the side panels 222', 222". Said rear panels 322', 322" partially wrap the rear surface of the envelope 10 so to be arranged in a position adjacent to the rear wall of the outer container 12. Said innerframe 22 forms therefore, the stiffening element of the same envelope 10 and of the package 2, allowing a better protection of the group 110 of cigarettes against mechanical stress, as illustrated in FIG. 16.

The access to the extraction opening 14 of the envelope 10 and, consequently, to the group 110 of cigarettes, is obtained by means of the access opening with which the container 12 is provided.

The covering of the extraction opening 14 is obtained by coupling to the innerframe 22, which defines the stiffening element, a reclosable opening system, for example as described in the previous embodiments. In the attached FIGS. 14 and 17, the reclosable opening system 50 is formed by the frame panel 30, illustrated in FIGS. 5A-5B, on which the closing element 40 is superimposed, illustrated in FIGS. 6A-6B. Said adhesive structure, illustrated in FIG. 7, corresponds to the same structure previously described for the first embodiment of the package 1, to which reference is made for every detail.

Unlike the first embodiment, in the package 2 of cigarettes according to the present invention, the stiffening element is thus formed by the innerframe 22 to which the opening system is fastened. In particular, said fastening is made by firmly superimposing the frame panel on at least two opposite walls of the innerframe 22 and at the access opening.

Figure 17:
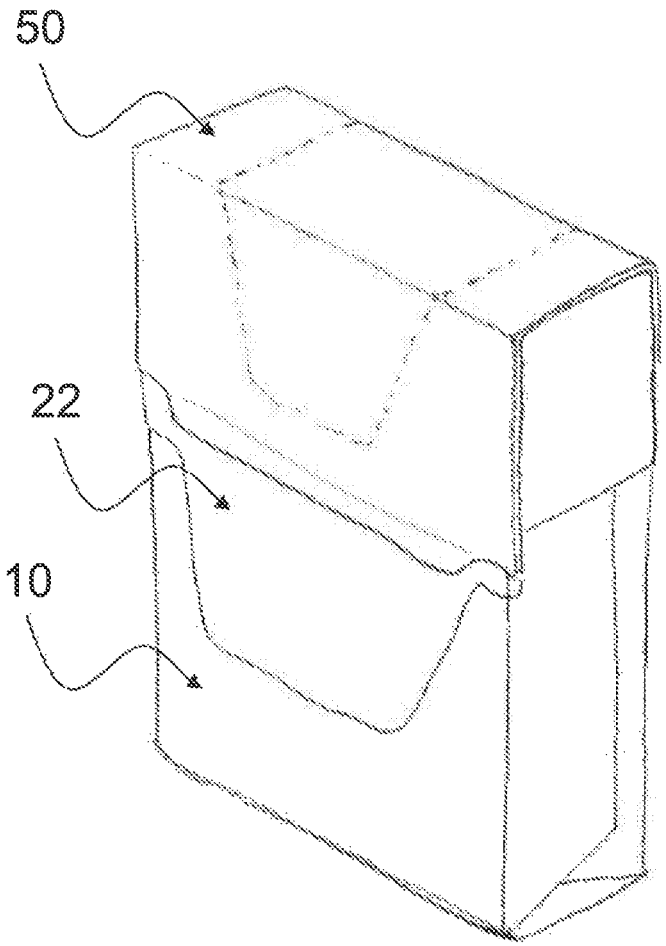
FIG. 17 is a front perspective view of the coupled envelope-innerframe of FIG. 16 provided with the reclosable opening system of FIG. 7.

As illustrated in FIG. 17, the frame panel 30 is integrally coupled to the innerframe 22 at the front panel 122 and at the rear panels 322', 322", parallel and opposite to the same. In particular, the frame panel 30 extends between said front wall 122 and rear 322', 322" walls covering the extraction opening 14. Said frame panel 30 entirely covers the extraction opening and defines the top wall of the envelope 10, which, as previously described, is devoid of wrapping material in said portion.

The arrangement of the two panels 30, 40 on the innerframe 22 allows to obtain a package provided with a reclosable sealing panel even in the presence of substantially paper material both for the innerframe 22 and for the envelope 10. The reclosable opening system 50 covers, therefore, the top portion of the envelope 10, left uncovered also by the innerframe 22, defining the head portion.

In use, the opening of the package 2 is obtained by first lifting the lid 312 hinged to the container 12 and then by lifting the closing panel 40 with respect to frame panel 30 allowing access to the extraction opening 14 of the group 110 of cigarettes. In particular, the steps that define the lifting of the closing panel 40 correspond to what has already been disclosed for the same reclosable opening system 50 of the package 1, to which reference is made.

Figure 18:
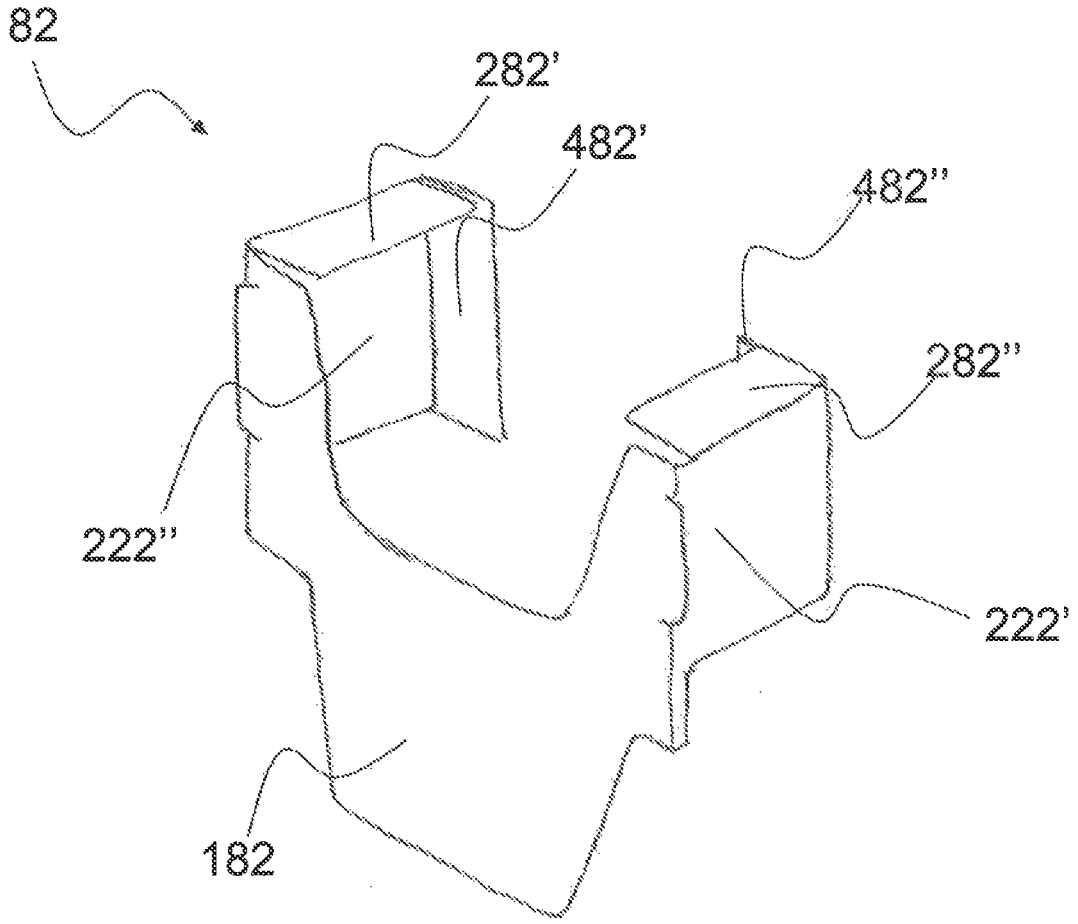
FIG. 18 is a front perspective view of a second embodiment of the innerframe according to the present invention.

Alternatively, a second embodiment of the "rigid hinge-lid" package, illustrated in FIG. 18, provides a different conformation for the innerframe 82. The latter is provided with a pair of rear panels 482', 482" separated and wrapping at least partially the rear surface of the envelope 10 and a pair of top panels 282', 282" that extend from the side panels and partially on the top surface of said envelope 10. The top panels 282', 282", the rear panels 482', 482" and the front panel 182 define, therefore, the access opening to the inner envelope. The opening system, for example according to one of the previously described system, is fastened to the innerframe 22 by firmly superimposing the frame panel on the rear panels, on the top panels and on the front panel. In this way, the opening system entirely covers the extraction opening and the top surface.

What has been previously disclosed for the package 2 can be applied, mutatis mutandis, to a package produced with an innerframe provided with top and rear panels as illustrated in FIG. 18. The shape of the innerframe 82 and, in particular, the presence of the top 282', 282" and rear 482', 482" panels allows to stiffen the positioning of the frame panel, making it more adherent to the package and, in particular, to the same innerframe 82, minimizing the gaps between the two elements when coupled.

Figure 19:
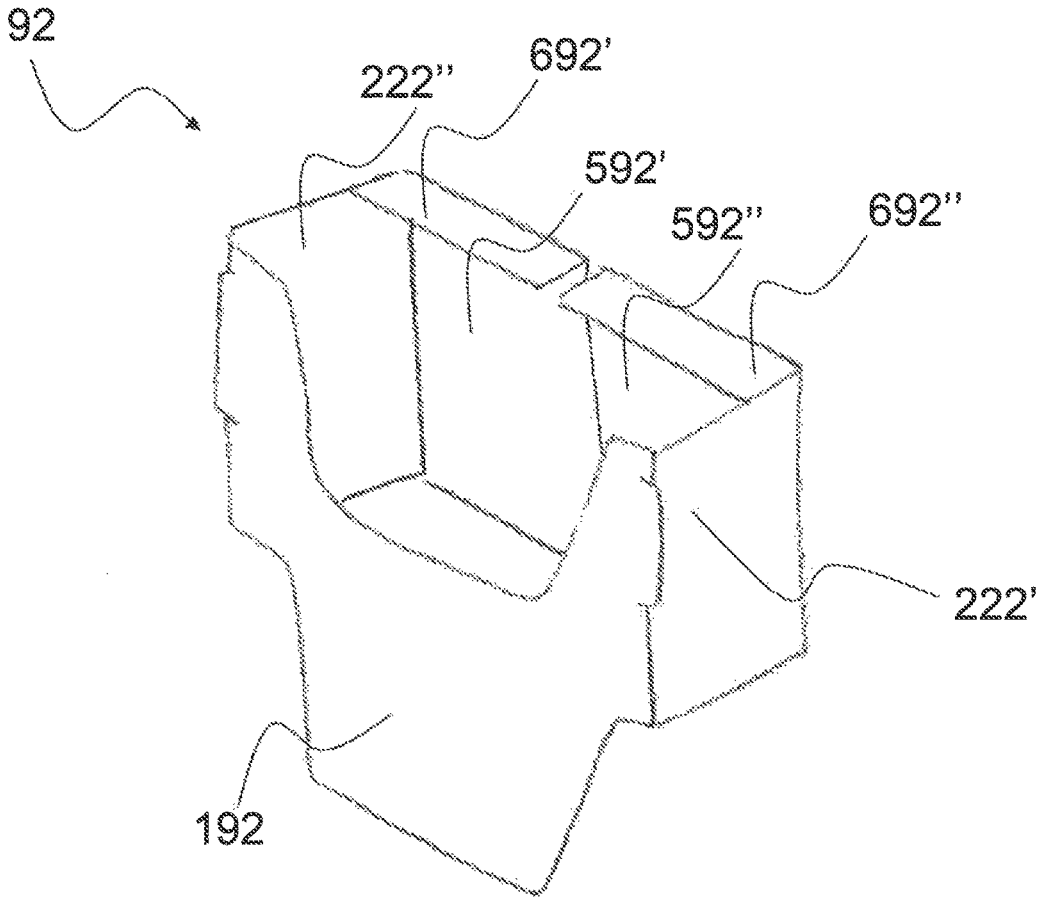
FIG. 19 is a front perspective view of a third embodiment of the innerframe according to the present invention.

Finally, in a third embodiment of the "rigid hinge-lid" package, illustrated in FIG. 19, the innerframe comprises a pair of rear panels 592', 592" separated and wrapping at least partially the rear surface of the envelope 10 and a pair of top panels 692', 692" extending from the rear panels 592', 592" and partially on the top surface. The top panels 692', 692", the rear panels 592', 592" and the front panel 192 define, therefore, the access opening to the envelope 10. The opening system is, therefore, fastened to the innerframe by firmly superimposing the frame panel to the rear panels 592', 592", to the top panels 692', 692" and to the front panel. In this way, the opening system entirely covers the extraction opening 14 and the top surface of the envelope 10.

What has been previously disclosed for the package 2 can be applied, mutatis mutandis, to a package produced with an innerframe provided with top and rear panels as illustrated in FIG. 19. The shape of the innerframe 92 and, in particular, the presence of the top 692', 692" and rear 592', 592" panels allows to stiffen the positioning of the frame panel 30, making it more adherent to the package and, in particular, to the same innerframe 92, minimizing the gaps between the two elements when coupled.

Therefore, all the additional panels of the innerframe described in the second and third embodiment of the "rigid hinge-lid" package allow to stiffen the positioning of the frame panel and to make it more adherent to the same package and the innerframe itself. In particular, the side panels make possible the continuous coupling of the frame panel to the innerframe minimizing the gaps between the two elements.

The terms "front", "rear", "top", "bottom", "side" and other terms used to describe the positions with respect to the surfaces of the envelope, of the container walls, of the innerframe panels and of the panel surfaces of the opening system refer to the package arranged in an upright position when frontally observed.

The production of a reclosable package of cigarettes according to the present invention can be implemented by means of known type packing machines, for example by the machine model X2 or X500 produced by G.D. Company Limited.

The packing machine (not illustrated) is provided with a first unwinding line for a reel of wrapping tape of the permeable to fluids type, suited for the subsequent production of the envelope 10. Said first unwinding line comprises a first cutting unit to obtain sheets of wrapping material, possibly provided with pre-weakened or entirely removed portions at the extraction opening 14, properly cutting at a predetermined pitch the above-mentioned wrapping tape.

Downstream from the first unwinding line, the packing machine is provided with a second forming line to form the groups of cigarettes 110 and the respective envelope 10 enclosing the latter. The second forming line comprises a first transfer wheel which is rotatable around a respective horizontal axis of rotation. The latter receives in succession the groups of cigarettes 110 and transfers them to a second packing wheel provided with a number of peripheral pockets at a first packing unit. At the second packing wheel, rotatable around its own vertical axis of rotation, each pocket receives the group of cigarettes 110 and the respective wrapping sheet obtained by the pitch cut. The rotation of the second packing wheel allows, therefore, to fold the sheet of wrapping material enclosing the above-mentioned formed group of cigarettes 110, to produce the envelope 10 provided with the extraction opening 14. In particular, the winding of the wrapping sheet takes place starting from the head of the cigarettes, so that the pre-weakening or the removal of the surface portion defining the extraction opening 14 will be positioned at the tail of the cigarettes, coinciding with the filter portion. Upon the rotation of the second packing wheel follows, therefore, the completion of the couplings of the envelope 10 with the formation of the rear and side superimposing flaps of the same.

A third wheel acts as a mere transfer device for the envelope 10 formed by the first unit, to a second unit of the same packing machine suited to fold a blank, enclosing the envelope 10 inside. This second unit has different features depending on whether the blank defines a "soft-rigid" type package or a "rigid hinge-lid" type package, but said features of known type will not be further detailed. In any case, a stiffening element is wound along at least two opposite surfaces of the envelope 10 and at the extraction opening 14, defining a partially wrapped package.

The second unit comprises a fourth packing wheel rotating around a respective vertical axis of rotation and provided with a plurality of peripheral pockets. The second packing unit is provided, finally, with a fifth packing wheel rotating around a respective horizontal axis of rotation, perpendicular to the axis of rotation of said fourth packing wheel, and which is in turn provided with a plurality of peripheral pockets.

The fourth packing wheel is partially superimposed on the third transfer wheel and has a peripheral pocket suited to transfer the envelope 10, coupled to the blank fed from a specific feeding line, to the corresponding peripheral pocket of the fifth packing wheel.

The latter receives, then, each inner envelope 10 and the respective blank performing the folds necessary to produce the package 1 or 2 of cigarettes according to the present invention.

In particular, the package of cigarettes 2 ("rigid hinge-lid") is obtained by folding the blank thus shaping the rigid outer container 12 enclosing the envelope 10.

The innerframe 22 of the package 2 is produced starting from a blank different with respect to the one that produces the outer container 12. In particular, the innerframe 22 is applied to the envelope 10 in the fourth packing wheel of the packing machine 100 at the extraction opening 14.

The application of the reclosable opening system 50 to the stiffening element, defined by the innerframe 22, is obtained with a partially-wrapped package, before the blank is fully folded around the inner envelope 10. Said application is obtained by firmly superimposing the frame panel 30 on at least two opposite walls of the stiffening element and at the extraction opening 14.

In particular, the packing machine is provided with two additional labeling devices placed in parallel. Each of said labeling devices is provided with suitable unwinding and cutting means suited to unwind one of the two tapes defining, respectively, with cuts of predetermined pitch, the frame panel 30 and the closing panel 40. As previously described, the frame panel 30 has the bottom surface provided with non-repositionable adhesive in a first coupling portion 32 and is devoid of adhesive (or has an opening) in a first contact portion 31, which in the embodiment described, corresponds to the movable portion. In addition, the same panel 30 is devoid of adhesive on the top surface. The closing panel 40 has the bottom surface provided with a non-repositionable adhesive in a second coupling portion 42, non-drying repositionable adhesive in a adhesion portion 43. Moreover, also said closing panel 40 is devoid of adhesive on the top surface.

Therefore, the definition of the package 2 according to the present invention provides that the step of applying the reclosable opening system 50 comprises first to couple and firmly fasten the frame panel 30 on at least two opposite walls of the stiffening element 40 and at the extraction opening 14; subsequently, the closing panel 40 is applied in a removable manner to the frame panel 30, closing the extraction opening 14. In particular, the first coupling portion 32 of the frame panel 30 is superimposed and coupled to the stiffening element (defined by the innerframe 22 in the embodiment described herein) at the extraction opening 14. Said coupling is made by the first labeling device after the pitch cut is made. The provision of different adhesive on the surface of the frame panel 30, in relation to predetermined glue maps, can thus be performed on the same labeling device before the cut, using one or more gumming devices, or can be defined in the production step of the tape reel. In the last described solution, the labeling device is simpler and has fewer problems related to the management of the different types of adhesive. Finally, the second coupling portion 42 and the adhesion portion 43 of the closing panel 40 are coupled to the top surface of the frame panel 30. This coupling is made by the second labeling device after the pitch cut is made, as already described for the first labeling device.

In one alternative packaging embodiment, the reclosable opening system 50 can be entirely defined before the coupling to the stiffening element defined by the innerframe 22. In this case, the steps for defining the package 2, according to the present invention, provide firstly coupling and firmly fastening the closing panel 40 to the frame panel 30; subsequently, the frame panel 30 is coupled and firmly fastened on at least two opposite walls of the stiffening element and at the extraction opening 14. In particular, the bottom surface of the closing panel 40 is coupled to the top surface of the frame panel 30. In this way, the reclosable opening system 50 is entirely defined before being laid out and coupled to the innerframe 22. Subsequently, the bottom surface of the frame panel 30 provided with the closing panel is firmly coupled to the stiffening element at the extraction opening 14. Said packaging embodiment can therefore be made by the aforesaid two labeling devices arranged in sequence and not in parallel. Alternatively, a single labeling device can be used, provided with suitable gumming means which alternately define a piece of the frame panel 30 and a piece of the closing panel 40.

Finally, according to a further packaging embodiment in accordance with the present invention, the panels 30, 40 defining the reclosable opening system 50 can be made on different portions of a single piece of tape. In particular, the adhesive structure 50 can be made by superimposing different portions of the same piece of tape. In said case, the steps for defining the package, according to the present invention, provide firstly wrapping the piece of tape around the stiffening element until the superimposing of the portion defining the closing panel on the portion defining the frame panel. Therefore, the bottom surface of the piece defining the closing panel is coupled to the top surface of the piece defining the frame panel. In said case, the production of the reclosable opening system is particularly simplified because only one piece of tape needs to be managed.

Downstream from the coupling of the reclosable opening system 50, at the second packing unit and by means of the fifth packing wheel, according to what has been previously described, the blank is folded around the inner envelope 10 to form the container 12, and then the reclosable package 2 of cigarettes according to the present invention.

Similar considerations are valid for producing the package 1 wherein the reclosable opening system 50 is applied after the envelope 10 is wound with the blank defining the container 20 devoid of the innerframe.

The reclosable package of cigarettes according to the present invention and described above has numerous advantages.

Firstly, it is possible to produce a reclosable and partially resealable package with the use of inexpensive materials, so as to ensure reclosability of the package and at the same time maintain minimum production costs.

In addition, the reclosable package of cigarettes according to the present invention allows to considerably simplify the production of a reclosable package by means of simple labelers for defining the frame panels and closing panels that define the adhesive structure.

Finally, the reclosable package of cigarettes described above can be produced in a simple and inexpensive manner using a standard packing machine (which only needs minor modifications). The production of the package does not require, therefore, the use of special packaging machines having considerable design and production cost.

The invention claimed is:

1. A reclosable package (1; 2) of cigarettes, comprising:

a group (110) of cigarettes;

a soft envelope (10) having a parallelepiped shape and comprising a front surface (11), a rear surface, a top surface, a bottom surface and two side surfaces (13), said envelope (10) encloses said group (110) of cigarettes and is provided with an extraction opening (14) for said cigarettes;

a stiffening element (20; 22) wrapping said envelope (10) along at least two opposite surfaces of said envelope (10) and at said cigarette extraction opening (14);

a reclosable opening system (50; 50') consisting in an adhesive closing panel (40; 40') superimposed in a removable manner on an adhesive frame panel (30), said opening system (50; 50') covers said extraction opening (14);

wherein said closing panel (40; 40') is movable between an opening position, in which said closing panel (40; 40') is at least partially detached from said frame panel (30) for accessing said extraction opening (14), and a closing position, in which said closing panel (40; 40') is superimposed on said frame panel (30) closing said extraction opening (14); and wherein said opening system (50; 50') is fastened to said stiffening element (20; 22) by firmly superimposing said frame panel (30) on at least two opposite walls of said stiffening element (20; 22) and at said extraction opening (14).

2. The package (1; 2) of cigarettes according to claim 1, wherein:

said frame panel (30) comprises a bottom surface at least partially provided with non-repositionable adhesive and a top surface devoid of adhesive;

said closing panel (40; 40') comprises a bottom surface at least partially provided with repositionable adhesive, a top surface devoid of adhesive, and a gripping tab (41; 41') devoid of adhesive;

wherein the bottom surface of said closing panel (40; 40') is superposed on the top surface of said frame panel (30); and wherein the bottom surface of said frame panel (30) is superimposed on said stiffening element (20; 22) at said extraction opening (14).

3. The package (1; 2) according to claim 1, wherein said extraction opening (14) is made by partially or entirely removing the wrapping material from said top surface, and wherein said opening system (50; 50') entirely covers said extraction opening (14).

4. The package (1; 2) according to claim 3, wherein said extraction opening (14) is made by further removing at least partially the wrapping material from said front surface (11) in continuity with the wrapping material removed from said top surface; and wherein said opening system (50; 50') entirely covers said extraction opening (14).

5. The package (1; 2) according to claim 1, wherein said envelope (10) is partially or entirely in a material permeable to fluids.

6. The package (1; 2) according to claims 1, wherein said envelope (10) is partially or entirely in a paper material.

7. The package (1; 2) according to claims 1, wherein said frame panel (30) is provided with an opening or with a movable portion (31) or with a removable portion at said extraction opening (14).

8. The package (1) according to claim 1, wherein said stiffening element is a container (20; 61; 62; 63) having a parallelepiped shape enclosing said envelope (10) and comprising a front wall (21), a rear wall, a top wall, a bottom wall and two side walls (23), said container (20) is provided with an access opening (24) for accessing said envelope (10) made by partially or entirely removing the wrapping material from said top wall at said extraction opening (14), and wherein said opening system (50; 50') is fastened to said container (20; 61; 62; 63) by firmly superimposing said frame panel (30) on at least two opposite walls of said container (20; 61; 62; 63) and at said access opening (24).

9. The package (1) according to claim 8, wherein said access opening (24) is made by removing entirely the wrapping material from said top wall, and wherein said opening system (50; 50') is fastened to said container (20; 61; 62; 63) by firmly superimposing said frame panel (30) on two opposite walls of said container (20; 61; 62; 63), said opening system (50; 50') covers said extraction opening (14) and entirely defines said top wall.

10. The package (1) according to claim 8, wherein said opening system (50; 50') is fastened to said container (20; 61; 62; 63) by firmly superimposing said frame panel (30) on at least said front (21) and rear walls.

11. The package (1) according to claims 9, wherein said opening system (50; 50') is fastened to said container (20; 61; 62; 63) by firmly superimposing said frame panel (30) on at least said front (21) and rear walls, wherein said access opening (24) is made by further removing at least partially the wrapping material from said front wall (21) in continuity with the front portion removed from said top wall, and wherein said opening system (50; 50') is fastened to said container (20; 61; 62; 63) by firmly superimposing said frame panel (30) on said front (21) and rear walls of said container, said opening system (50; 50') covers said access opening (24) and entirely defines said top wall.

12. The package (1) according to claims 8, wherein said container (61) comprises two side flaps (161'; 161") extending respectively from said walls (23) and partially on said top surface, and wherein said opening system (50; 50') is fastened to said container (61) by firmly superimposing said frame panel (30) on said side flaps (161'; 161") and on said front (21) and rear walls.

13. The package (1) according to claims 8, wherein said container (62) comprises a rear flap (162) which extends from said rear wall and partially on said top surface, and wherein said opening system (50; 50') is fastened to said container (62) by firmly superimposing said frame panel (30) on said rear flap (162) and on said front (21) and rear walls.

14. The package (1) according to claim 8, wherein said container (63) comprises two side flaps and a rear flap, said side flaps extend respectively from said side walls (23) and partially on said top surface, said rear flap extends from said rear wall and partially on said top surface, and wherein said opening system (50; 50') is fastened to said container (63) by firmly superimposing said frame panel (30) on said side and rear flaps and on said front and rear walls.

15. The package (1) according to claim 14, wherein said side and rear flaps are made into a single element (163).

16. The package (2) according to claims 1 and further comprising a container (12) having a parallelepiped shape enclosing said envelope (10) and provided with an access opening to said envelope (10) and with a hinged lid (312), wherein said stiffening element is an innerframe (22; 82; 92) partially wrapping said envelope (10) and comprising at least a front panel (122; 182; 192), two side panels (222', 222"), and at least a rear panel (322', 322"; 482', 482"; 592', 592"), said innerframe (22; 82; 92) is arranged at said access opening (24) and is interposed between said container (12) and said envelope (10), and wherein said opening system (50; 50') is fastened to said innerframe (22; 82; 92) by firmly superimposing said frame panel (30) on two opposite walls and at said access opening (24).

17. The package (2) according to claim 16, wherein said innerframe (22; 82; 92) comprises a pair of rear panels (322', 322"; 482', 482"; 592', 592") separated from each other and wrapping at least partially said rear surface, and wherein said opening system (50; 50') is fastened to said innerframe (22; 82; 92) by firmly superimposing said frame panel (30) on said rear panels (322', 322"; 482', 482"; 592', 592") and on said front panel (122; 182; 192), said opening system (50; 50') entirely covers said extraction opening (14) and said top surface.

18. The package (2) according to claim 16, wherein said innerframe (82) comprises a pair of top panels (282', 282") which extend from said side panels (222', 222") and partially on said top surface, and wherein said opening system (50; 50') is fastened to said innerframe (82) by firmly superimposing said frame panel (30) on said top panels (282', 282"), on said rear panels (482', 482") and on said front panel (182), said opening system (50; 50') entirely covers said extraction opening (14) and said top surface.

19. The package (2) according to claims 17, wherein said innerframe (82) comprises a pair of top panels (282', 282") which extend from said side panels (222', 222") and partially on said top surface, wherein said opening system (50; 50') is fastened to said innerframe (82) by firmly superimposing said frame panel (30) on said top panels (282', 282"), on said rear panels (482', 482") and on said front panel (182), said opening system (50; 50') entirely covers said extraction opening (14) and said top surface, wherein said innerframe (82) comprises a pair of rear panels (482', 482") separate from each other and wrapping at least partially said rear surface and a pair of top (282', 282") panels which extend from said side panels (222', 222") and partially on said top surface, and wherein said opening system (50; 50') is fastened to said innerframe (82) by firmly superimposing said frame panel (30) on said rear panels (482', 482"), on said top panels (282', 282") and on said front panel (182), said opening system (50; 50') entirely covers said extraction opening (14) and said top surface.

20. The package (2) according to claims 16, wherein said innerframe (92) comprises a pair of rear panels (592', 592") separated from each other and wrapping at least partially said rear surface and a pair of the top panels (692', 692") which extend from said rear panels (592', 592") and partially on said top surface, and wherein said opening system (50; 50') is fastened to said innerframe (92) by firmly superimposing said frame panel (30) on said rear panels (592', 592"), on said top panels (692', 692") and on said front panel (192), said opening system (50; 50') entirely covers said extraction opening (14) and said top surface.

21. A packing method of a package (1; 2) of cigarettes according to claim 1, comprising the steps of:

feeding said group (110) of cigarettes;

defining said soft envelope (10) provided with an extraction opening (14) by wrapping said group (110) of cigarettes with a sheet of wrapping material;

wrapping said stiffening element (20; 22) along at least two opposite surfaces of said envelope (10) and at said extraction opening (14), defining said package (1; 2) partially wrapped; and applying said reclosable opening system (50; 50') to said package (1; 2) partially wrapped by firmly superimposing said frame panel (30) on at least two opposite walls of said stiffening element (20; 22) and at said extraction opening (14).

22. The packing method according to claim 21, wherein the step of applying said opening system (50; 50') comprises:

coupling and firmly fastening said frame panel (30) on at least two opposite walls of said stiffening element (20; 22) and at said extraction opening (14), and thereafter detachably coupling said closing panel (40; 40') on said frame panel (30) closing said extraction opening (14).

23. The packing method according to claim 21, wherein the step of applying said opening system (50; 50') comprises:

detachably coupling said closing panel (40; 40') on said frame panel (30), and thereafter coupling and firmly fastening said frame panel (30) on at least two opposite walls of said stiffening element (20; 22) and at said extraction opening (14).

* * * * *